US012252284B2

(12) United States Patent
Takai et al.

(10) Patent No.: US 12,252,284 B2
(45) Date of Patent: Mar. 18, 2025

(54) TOFU PACKAGING APPARATUS

(71) Applicant: TAKAI TOFU & SOYMILK EQUIPMENT CO., Ishikawa (JP)

(72) Inventors: Toichiro Takai, Ishikawa (JP); Masahide Takeda, Ishikawa (JP)

(73) Assignee: TAKAI TOFU & SOYMILK EQUIPMENT CO., Ishikawa (JP)

( * ) Notice: Subject to any disclaimer, the term of this patent is extended or adjusted under 35 U.S.C. 154(b) by 109 days.

(21) Appl. No.: 17/904,358

(22) PCT Filed: Apr. 1, 2020

(86) PCT No.: PCT/JP2020/015117

§ 371 (c)(1),
(2) Date: Aug. 16, 2022

(87) PCT Pub. No.: WO2021/199389

PCT Pub. Date: Oct. 7, 2021

(65) Prior Publication Data

US 2023/0070964 A1 Mar. 9, 2023

(51) Int. Cl.
*B65B 43/46* (2006.01)
*B65B 5/04* (2006.01)
(Continued)

(52) U.S. Cl.
CPC ..... *B65B 43/46* (2013.01); *B65B 5/04* (2013.01); *B65B 25/06* (2013.01); *B65B 57/10* (2013.01); *B65B 65/006* (2013.01)

(58) Field of Classification Search
None
See application file for complete search history.

(56) References Cited

U.S. PATENT DOCUMENTS 5,249,513 A 10/1993 Ueda

FOREIGN PATENT DOCUMENTS

JP S61-000113 A 1/1986
JP S61-000114 A 1/1986
(Continued)

OTHER PUBLICATIONS

An Office Action; "Notice of Reasons for Refusal," mailed by the Japanese Patent Office on Dec. 12, 2023, which corresponds to Japanese Patent Application No. 2023-077928 and is related to U.S. Appl. No. 17/904,358; with English language translation.
(Continued)

*Primary Examiner* — Tanzim Imam
(74) *Attorney, Agent, or Firm* — Studebaker Brackett PLLC

(57) ABSTRACT

A tofu packaging apparatus includes: a pack covering device configured to cover each of a plurality cakes of tofu with a pack that is in a reversed state, the plurality of cakes of tofu being arranged at predetermined intervals in a front, rear, left, and right on a conveyance surface of a transfer conveyor; and an inversion device disposed on a downstream side of the pack covering device, the inversion device being configured to invert the tofu upside down while the tofu is covered with the pack. The pack covering device includes a tip end grip portion configured to grip the pack in the reversed state and cover the tofu halfway with the pack. The inversion device is configured to invert the tofu covered with the pack in the reversed state to store the tofu in the pack.

14 Claims, 13 Drawing Sheets

(51) Int. Cl.

| | |
|---|---|
| ***B65B 25/06*** | (2006.01) |
| ***B65B 57/10*** | (2006.01) |
| ***B65B 65/00*** | (2006.01) |

(56) References Cited

FOREIGN PATENT DOCUMENTS

| | | | | |
|---|---|---|---|---|
| JP | S61203318 | A | * | 9/1986 |
| JP | S63-203516 | A | | 8/1988 |
| JP | H05-137528 | A | | 6/1993 |
| JP | H08-217029 | A | | 8/1996 |
| JP | 2004-222618 | A | | 8/2004 |
| JP | 2006-212005 | A | | 8/2006 |
| JP | 2007006759 | A | * | 1/2007 |
| JP | 2014024563 | A | * | 2/2014 |
| JP | 2014-058334 | A | | 4/2014 |
| JP | 2014-207901 | A | | 11/2014 |
| JP | 2014-226759 | A | | 12/2014 |
| JP | 2015-212172 | A | | 11/2015 |
| JP | 2015-227204 | A | | 12/2015 |
| JP | 2016-047725 | A | | 4/2016 |
| JP | 2016-215316 | A | | 12/2016 |
| JP | 2017-170550 | A | | 9/2017 |
| JP | 2018-034884 | A | | 3/2018 |
| JP | 2018-161074 | A | | 10/2018 |
| JP | 2018-197159 | A | | 12/2018 |
| KR | 10-2014-0000020 | A | | 1/2014 |
| WO | WO-2009150755 | A1 | * | 12/2009 ..... B65B 43/44 |
| WO | WO-2019210954 | A1 | * | 11/2019 ..... F16J 15/3404 |

OTHER PUBLICATIONS

"Notice of Reasons for Refusal" Office Action issued in JP 2018-247900; mailed by the Japanese Patent Office on Nov. 8, 2022.

International Search Report issued in PCT/JP2020/015117; mailed Jun. 16, 2020.

Written Opinion issued in PCT/JP2020/015117; mailed Jun. 16, 2020.

* cited by examiner

TOFU PACKAGING APPARATUS

TECHNICAL FIELD

The present invention relates to a tofu packaging apparatus that continuously and automatically performs processes from cutting of continuously manufactured sheet-shaped tofu to packaging of the tofu.

BACKGROUND ART

Generally, in a production process of silken tofu, a soymilk as a raw material is coagulated and aged in a mold with a coagulant added, and in a production process of firm tofu, a soymilk is coagulated and aged in a suitable container (such as a tub, a bucket, or a mold) in the same manner. Next, the coagulated and aged product is poured into a mold to be compacted and molded. Thereafter, and the tofu is produced by being taken out from the mold, cut into a predetermined size, and packed. In recent years, the number of continuous mass production lines have increased. In the continuous mass production line, sheet-shaped silken tofu continuously coagulated and aged or the firm tofu obtained by being crushed and continuously pressed and shaped is cut out into cakes one by one, and each of the cakes of tofu is packaged in a pack.

An example of a tofu packaging apparatus in the related art is disclosed in Patent Literature 1. An automatic continuous tofu packaging apparatus according to Patent Literature 1 includes cutting means (not shown) for cutting molded tofu in a water tank in a longitudinal direction and a lateral direction; a tofu guiding device that guides cakes of tofu in one foremost lateral row (i.e., aligned cakes of tofu) of cakes of tofu obtained by cutting the molded tofu toward a pack supply device installed outside the water tank; a transfer conveyor that is positioned on an extension line of the tofu guiding device and guides the tofu in the one lateral row (the aligned cakes of tofu) supplied from the tofu guiding device to the pack supply device; and the pack supply device that sequentially packages each of the transferred cakes of tofu in the one lateral row (the aligned cakes of tofu). By using this apparatus, it is possible to automatically and continuously perform a cutting process of the molded tofu in the water tank and then a packaging process.

CITATION LIST

Patent Literature

Patent Literature 1: JP-A-S63-203516

SUMMARY OF INVENTION

Technical Problem

However, in Patent Literature 1, a pack is supplied from above to the tofu being cut and conveyed. In this case, the pack is supplied so as to be pressed vertically against the tofu from above, and the tofu may be damaged at this time by a pressing operation of the pack, which causes a problem of deteriorating a yield. Consequently, high-speed packaging is difficult, and an upper limit of a processing capacity is 3,000 cakes/hour.

In addition, with such a method of supplying the pack, air remains between the tofu and the pack, so that when the pack is covered quickly, the tofu is easily damaged by the increased air flow generated by the air in the pack pushed out by the tofu. Consequently, workability is deteriorated due to trouble in the pack covering process. As a solution to this problem, for example, increasing a size of the pack relative to that of the tofu to increase a gap therebetween will allow release of the air easily. Alternatively, pressing the pack more strongly against the tofu will speed up accommodation of the tofu in the pack and increase productivity. However, in the former solution, when a size difference between the tofu and the pack is large, it is desirable from a viewpoint of protection of the tofu and handleability in distribution, but there is a problem of deterioration of an appearance due to a visible gap between the pack and the tofu to be large, and another problem of unnecessary increase of transportation cost due to increase of an amount of water in the pack. In the latter solution, there is a problem of further increase of a risk of damage of the tofu due to the pressing. In particular, in a case of relatively soft tofu such as silken tofu, air is hardly released and the risk of damage is increased so that there is a large problem in achieving quick packaging with good yield.

In addition, it is necessary to provide the pack supply device (so-called pack supply magazine) of Patent Literature 1 for each column of tofu arranged, and if the number of columns is large, an operation of supplying the pack is laborious.

The present invention is made in view of the above circumstances, and an object thereof is to provide a tofu packaging apparatus capable of speeding up packaging and quickly and accurately packaging even when the tofu is soft.

Solution to Problem

The object of the present invention above is achieved by a following configuration.

(1) A tofu packaging apparatus includes: a pack covering device configured to cover each of a plurality cakes of tofu with a pack that is in a reversed state, the plurality of cakes of tofu being arranged at predetermined intervals in a front, rear, left, and right on a conveyance surface of a transfer conveyor; and an inversion device disposed on a downstream side of the pack covering device, the invention device being configured to invert the tofu upside down while the tofu is covered with the pack, in which the pack covering device includes a tip end grip portion configured to grip the pack in the reversed state and cover the tofu halfway with the pack, and the inversion device is configured to invert the tofu covered with the pack in the reversed state to store the tofu in the pack.

(2) In the tofu packaging apparatus according to (1), the pack covering device includes a robot having a parallel link mechanism or a SCARA mechanism configured to drive the tip end grip portion three-dimensionally at high speed while the tip end grip portion grips the pack.

(3) In the tofu packaging apparatus according to (1) or (2), the inversion device includes: an inversion support portion configured to invert the conveyance surface; and a pack holding portion disposed along the conveyance surface on the inversion support portion, the pack holding portion being configured to hold the pack until the pack is inverted.

(4) In the tofu packaging apparatus according to (1) or (2), the inversion device includes: an inversion support portion configured to invert the conveyance surface; and a pack holding portion provided at a position facing the inversion support portion, the pack holding portion being configured to: accommodate and hold the tofu, the tofu being covered with the pack and slid from the conveyance surface to accommodate and hold the tofu; and guide the tofu while fixedly supporting the tofu until the pack is inverted upside down or rotationally move until the pack is inverted upside down.

(5) In the tofu packaging apparatus according to any one of (1) to (4), the pack covering device includes a first image sensor configured to detect a state of the tofu.

(6) In the tofu packaging apparatus according to (5), in response to detection of an abnormality in the tofu as a result of image analysis of the tofu by the image sensor, the tofu is not covered with the pack.

(7) In the tofu packaging apparatus according to any one of (1) to (6), wherein two units of pack covering devices are provided on left and right sides in a width direction of the conveyance surface, respectively, or three units of pack covering devices are provided in a center and on the left and right sides in the width direction of the conveyance surface, respectively.

(8) In the tofu packaging apparatus according to any one of (1) to (7), the pack covering device covers the tofu with the pack in an oblique posture with a downstream side of the pack down and an upstream side of the pack up.

(9) In the tofu packaging apparatus according to any one of (1) to (8), the tofu has a hardness of 20 gf/cm$^2$ to 100 gf/cm$^2$.

(10) In the tofu packaging apparatus according to any one of (1) to (9), the pack has a groove on an inner surface of the pack, the groove extending at least from a bottom portion of the pack toward an opening of the pack.

(11) The tofu packaging apparatus according to any one of (1) to (10), further includes: a pack supply device configured to supply the pack, in which the pack supply device includes at least one pack supply magazine configured to stock packs.

(12) In the tofu packaging apparatus according to (11), the pack supply device includes a conveyor configured to continuously convey the packs.

(13) In the tofu packaging apparatus according to (11) or (12), the pack supply device includes a second image sensor configured to detect a state of the packs.

(14) In the tofu packaging apparatus according to any one of (1) to (13), the pack covering device supports IP54 of a dustproof and waterproof grade or greater.

(15) In the tofu packaging apparatus according to any one of (1) to (14), the pack covering device includes a moving base portion.

Advantageous Effects of Invention

According to the above (1) of the present invention, since the tip end grip portion is set to grip the pack that is in the reversed state and cover the tofu halfway with the pack, it is possible to reduce damage to the tofu when being covered with the pack and to avoid damage to the tofu. Further, in the inversion device, the tofu covered with the pack halfway is inverted upside down and stored in the pack without applying an excessive force to the tofu. Consequently, in the course of changing the tofu from a horizontal posture to a vertical posture in a state where the tofu is contained in the pack, air in a space between the pack and the tofu is released well, and the tofu can be smoothly stored in the pack without difficulty without causing collapse of the tofu.

According to the above (2) of the present invention, the pack covering device includes the robot having the parallel link mechanism or the SCARA mechanism configured to drive the tip end grip portion three-dimensionally at high speed while the tip end grip portion grips the pack. Consequently, the pack can cover at high speed. A speed thereof is 0.6 seconds or less, or 100 CPM or more, in one reciprocation (cycle).

According to the above (3) of the present invention, the inversion device includes the inversion support portion configured to invert the conveyance surface; and the pack holding portion disposed along the conveyance surface on the inversion support portion, the pack holding portion being configured to hold the pack until the pack is inverted. Consequently, the pack accommodating the tofu can be inverted while being held on the conveyance surface so that the tofu can be stored in the pack while being conveyed.

According to the above (4) of the present invention, the inversion device includes the inversion support portion configured to invert the conveyance surface; and the pack holding portion provided at the position facing the inversion support portion, the pack holding portion being configured to: accommodate and hold the tofu, the tofu being covered with the pack and slid from the conveyance surface to accommodate and hold the tofu; and guide the tofu while fixedly supporting the tofu until the pack is inverted upside down or rotationally move until the pack is inverted upside down. Consequently, the pack accommodating the tofu can be inverted while moving to a position away from the conveyance surface.

According to the above (5) of the present invention, the pack covering device is provided with the image sensor capable of detecting the state of the tofu (chipping, foreign matter, air bubbles, orientation, posture, degree of sagging, and the like). Consequently, it is possible to measure and monitor a position, shape, orientation (inclination), and the like of the tofu, and based on detection information, it is possible to improve a speed of packaging and accuracy by controlling orientation of the pack with which the tofu is to be covered in accordance with orientation of the tofu.

According to the above (6) of the present invention, in response to detection of an abnormality in the tofu as a result of image analysis of the tofu by the image sensor, the tofu is not covered with the pack. Consequently, waste of the pack can be eliminated, and unnecessary work of an inspector can be reduced, so that workability can be improved. Further, since an inspection work in a subsequent step can be reduced, it is possible to allot the margin for the inspection and increase a reference level can be increased, thereby improving quality of a product.

According to the above (7) of the present invention, since pack covering devices are provided on both the left and right sides in the width direction of the conveyance surface, respectively, a target area of covering operation of the pack can be divided into two in the left-right direction of the conveyance surface, and an operation range of the pack covering device can be reduced, whereby a pack covering operation can speed up. In addition, by widening an operating range in a row direction, a width of a conveyance belt can be widened. Consequently, the number of tofu arranged in the row direction can be increased, and a space can be saved without increasing a machine length, whereby a high production capacity can be achieved.

According to the above (8) of the present invention, the pack covering device can always cover the tofu with the pack in the same state in a posture with the downstream side of the pack down and the upstream side of the pack up. As a result, since the pack always covers the tofu with the downstream side inclined downward, the tofu at the time of inversion is obliquely inserted into the pack from the downstream side to the upstream side, and residual air between the pack and the tofu is smoothly discharged. As a result, packaging can speed up.

According to the above (9) of the present invention, since the tofu has a hardness of 20 gf/cm$^2$ to 100 gf/cm$^2$, even when the tofu is damageable, the tofu can be packaged quickly and accurately. The tofu may have a substantially rectangular parallelepiped shape, a substantially cubic shape, or a substantially triangular prism shape such as silken tofu, firm tofu, soft tofu, soft firm tofu, grilled tofu obtained by grilling the tofu, fried silken tofu and fried firm tofu obtained by the above kinds of tofu, and deep-fried tofu that is puffed, and may be a form in which one cake of tofu a minimum unit or a plurality of cakes of tofu are stored in one pack.

According to the above (10) of the present invention, the pack has the groove on the inner surface of the pack, the groove extending at least from the bottom portion of the pack toward the opening of the pack. Consequently, when the tofu and the pack are inverted in a state where the tofu is covered with the pack and air sandwiched between the pack and the tofu is released, the groove on the inner surface of the pack functions as an air release path, whereby the air is released quickly, and the tofu can be stored in the pack quickly and smoothly without difficulty.

According to the above (11) of the present invention, the pack supply device configured to supply the pack is provided with the pack supply magazine configured to stock the packs. The number of supply magazines may be at least one for one pack supply device regardless of the number of columns of tofu. If a sufficient amount of packs is set in one magazine, an operator can perform other works until next replenishment. Nevertheless, in a recent tofu continuous line in which a capacity thereof exceeds 5,000 cakes/h and reaches 8,000 cakes/h to 12,000 cakes/h or more, the number of columns of tofu becomes 15 to 30, and the same number of pack supply magazines as the number of columns of tofu is provided, cost of the apparatus increases, an individual adjustment is necessary, setting the pack individually and manually is required, and one dedicated operator is required.

According to the above (12) of the present invention, the pack supply device includes the conveyor configured to continuously convey the packs, so that packs are continuously supplied, the packs during movement are subjected to image analysis by the image sensor, and the tip end grip portion of the robot can grasp the pack. Consequently, it is not necessary to stop the pack, and speedup is possible.

According to the above (13) of the present invention, the pack supply device includes a second image sensor configured to detect a state of the pack. Consequently, even when the pack is moving or inclined, the pack can be accurately gripped and received in accordance with a position or orientation of the pack, and the deformed or crushed pack can be removed.

According to the above (14) of the present invention, the pack covering device supports IP54 of the dustproof and waterproof grade or greater. In terms of the IP standard, the pack covering device supports IP54 or greater, and preferably IP65 or greater. The Ingress Protection standard (IP standard) is a waterproof and dustproof standard of an electronic device, which is defined by the International Electrotechnical Commission and also adopted by Japanese Industrial Standards, and indicates a supporting grade by an indication such as IP00 to IP68, IP69, and the like, and indicates a dustproof index to a tenth place and a waterproof index to a first place. The greater the number is, the more excellent a dustproof and waterproof function is.

According to the above (15) of the present invention, the pack covering device includes the moving base portion. It is preferable to have a margin in terms of the number of robots and a processing capacity so that even when one robot fails, other robots can compensate. Since a line has a high processing capacity, a demerit of time loss becomes large even in a case of a temporary failure. Therefore, a recovery function for compensation is important so that continuous production can be continued.

DESCRIPTION OF EMBODIMENTS

Hereinafter, embodiments of a tofu packaging apparatus to which the present invention is applied will be described in detail with reference to the drawings.

First Embodiment

Figure 1:
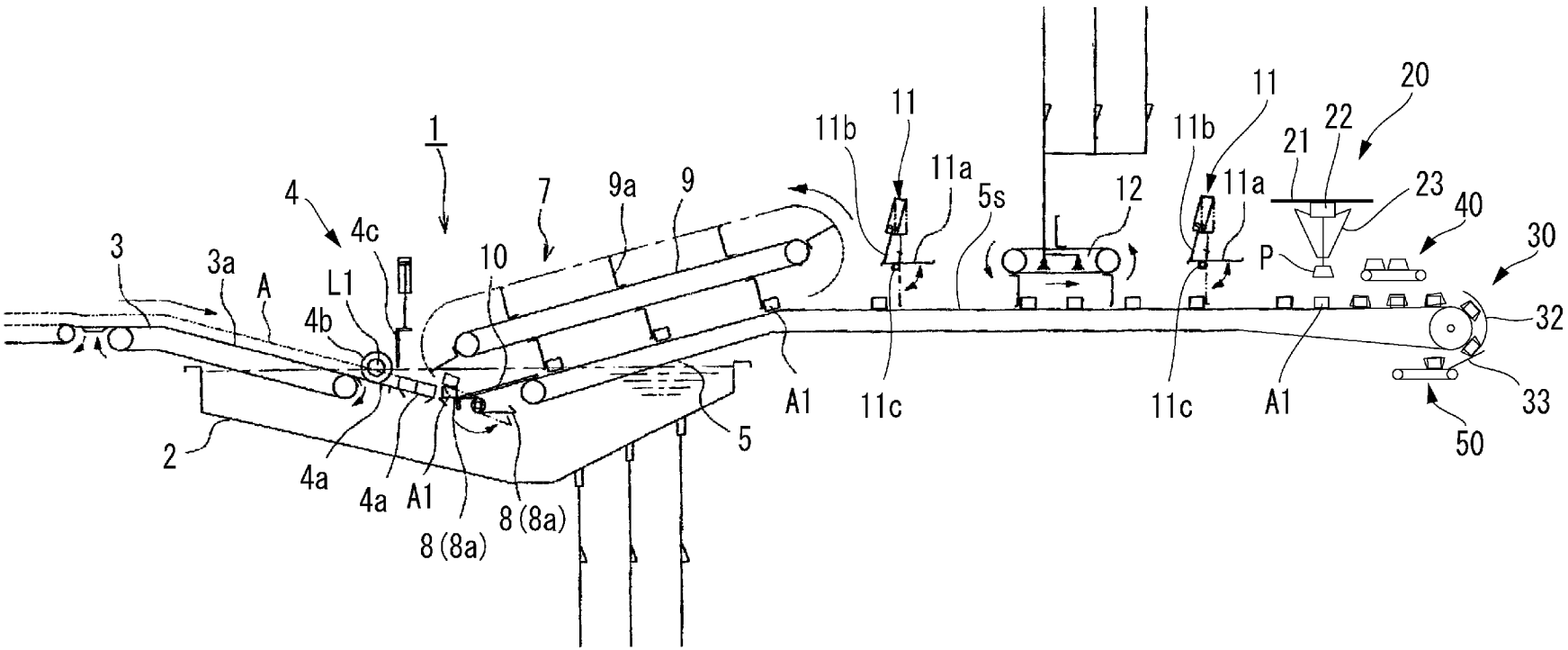
FIG. 1 is a schematic side view showing an overall view of a tofu packaging apparatus according to a first embodiment of the present invention.

As shown in FIG. 1, a tofu packaging apparatus 1 according to a first embodiment of the present invention includes a first transfer conveyor 3 that transfers a tip end of a continuous sheet-shaped tofu A into a water tank 2; cutting means 4 for cutting the continuous sheet-shaped tofu A from the tip end thereof sequentially in an appropriate order in a longitudinal direction and a lateral direction on land or in water to cut the tofu A into individual cakes of tofu Al; a second transfer conveyor 5 that sequentially disposes the cut tofu Al on land or in water apart from each other with an interval and transfers the tofu Al; a pack covering device 20 that is installed downstream of the second transfer conveyor 5 and sequentially covers and packages the transferred tofu Al with a pack P; and an inversion device 30 that is disposed on a downstream side of the pack covering device 20 and inverts the pack P (in a state in which the tofu Al is covered halfway) upside down. The packaging apparatus 1 further includes delivery means 7 that can smoothly transfer the continuous sheet-shaped tofu A (each tofu Al in a foremost lateral row) cut by the cutting means 4 from a first transfer conveyor 3 side to a second transfer conveyor 5 side.

The first transfer conveyor 3 is for transferring the tip end of the continuous sheet-shaped tofu A into the water tank 2, and is bent at a predetermined gradient from a vicinity of a peripheral edge portion on a rear side of the water tank 2 to enter the water tank 2. After the tip end of the continuous sheet-shaped tofu A transferred into the water tank 2 by the first transfer conveyor 3 is cut by the cutting means 4 in water or on land into appropriate one-cake size, the second transfer conveyor 5 sequentially arranges the cut cakes of tofu Al and transfers the tofu Al to an outside of the water tank 2 (on land). Further, on a downstream side of the second transfer conveyor 5, the pack covering device 20 that packages the transferred tofu sequentially on land is installed, so as to be contrived to perform a series of packaging operation steps on the second transfer conveyor 5 as much as possible from inside of water to semi-land or on land. The cutting means is not limited as long as adopting methods for cutting the continuous sheet-shaped tofu A into cakes one by one regardless of whether in water or on land by using any one of means (1) to (3). In the means (1), the tip end of the continuous sheet-shaped tofu A is cut longitudinally in a column direction, and then cut laterally into cakes one by one or into sets of a plurality of cakes one by one. In the means (2) the tip end of the continuous sheet-shaped tofu A is cut laterally into a thick band-shaped tofu dough having a width of a plurality of cakes, then cut longitudinally, and then cut laterally by one unit cake. In the means (3), the tip end of the continuous sheet-shaped tofu A is cut laterally into a thick band-shaped tofu dough having a width of a plurality of cakes, then cut laterally to have a width of one unit cake, and then cut longitudinally in the column direction by one unit cake. The tofu may be cut to have a size by one unit cake (minimum unit) at one time with a grid of cutting blades. In addition, the packaging apparatus 1 includes distribution and arrangement means 11 (lateral opening cutting blade, staggered arrangement, or the like) for distributing and arranging the cakes of tofu Al on the second transfer conveyor 5 at intervals in a left, right, front, and rear regardless of whether the tofu A and so on is in water or on land.

In the present application, a traveling direction of the continuous sheet-shaped tofu is referred to as the longitudinal direction or the column direction, and a direction perpendicular to the traveling direction is referred to as the lateral direction or a row direction.

The continuous sheet-shaped tofu A transferred by the first transfer conveyor 3 is cut in the longitudinal direction and the lateral direction by the cutting means 4 installed continuously on the first transfer conveyor 3. The cutting means 4 includes, for example, auxiliary bases 4*a*, 4*a* provided on an extension line of a conveyance surface 3*a* of the first transfer conveyor 3, and rotation blades 4*b* and press-cutting blades 4*c* provided above the auxiliary bases 4*a*, 4*a*. A plurality of rotation blades 4*b* configured to cut the continuous sheet-shaped tofu A in the longitudinal direction are mounted at predetermined intervals on a rotation shaft L1 extending perpendicular to the traveling direction of the continuous sheet-shaped tofu A above an auxiliary base 4*a* on a side closer to the first transfer conveyor 3 among the auxiliary bases 4*a*. When the continuous sheet-shaped tofu A is transferred from the first transfer conveyor 3 and passes through the auxiliary base 4*a*, the plurality of rotation blades 4*b* are rotated to cut the continuous sheet-shaped tofu A in the longitudinal direction.

Next, a slight gap is provided between the auxiliary bases 4*a*, 4*a*, and above the gap, the press-cutting blade 4*c* is mounted so as to be movable up and down such that the continuous sheet-shaped tofu A that has been cut in the longitudinal direction is further cut in the lateral direction. The press-cutting blade 4*c* is mounted on a tip end portion of a rod that operates in the vertical direction, and moves up and down when the continuous sheet-shaped tofu A cut in the longitudinal direction by the plurality of rotation blades 4*b* passes between the auxiliary bases 4*a*, 4*a* to cut the continuous sheet-shaped tofu A in the lateral direction for every predetermined length. The rotation blade 4*b* and the press-cutting blade 4*c* cut the continuous sheet-shaped tofu A into the tofu Al by one unit cake. Instead of the press-cutting blade, a knife type cutting blade that operates in the lateral direction may be provided.

Here, the continuous sheet-shaped tofu A may be cut in water or "semi-underwater" in which the continuous sheet-shaped tofu A is partially immersed in water on the first transfer conveyor 3 side, but it is preferable to cut the continuous sheet-shaped tofu A in a state of being completely immersed in water as it is easier to achieve cutting dimensional accuracy in consideration of deformation of the continuous sheet-shaped tofu A that is in a case of being soft. Cutting in air (on land) without water is possible if means for ensuring cutting accuracy (for example, means for fixing both end faces of the tofu with a holding plate during cutting, and the like) are used in combination. In this case, some cutting means is provided on an upstream side of the first transfer conveyor 3 to cut the continuous sheet-shaped tofu A, and the continuous sheet-shaped tofu A is transferred into the water tank 2 in a cut state. It is effective to replace water in the water tank 2 with, for example, potable clean water such as tap water or well water, water at a high temperature of 60° C. or more and 99° C. or less, or water prepared by containing hypochlorous acid (trade name: Haccpper water) or sodium hypochlorite of a food additive standard to have an effective concentration of 0.1 ppm to 200 ppm, or use hygienic means in combination.

The cutting means of the continuous sheet-shaped tofu A is not limited to this form, and may be any means as long as the means cuts the continuous sheet-shaped tofu A into the tofu Al by one unit cake. For example, the cutting means 4 may include first lateral cutting and distributing means for cutting off the tip end of the continuous sheet-shaped tofu A into a thick band-shaped tofu dough having a width of a plurality of cakes at a rear end of the first transfer conveyor 3, and then, may include longitudinal cutting and distributing means for transferring the thick band-shaped tofu dough to the second transfer conveyor 5 and longitudinally cuts the thick band-shaped tofu dough to widen an interval in the lateral direction, and thereafter, may include second lateral cutting and distributing means for cutting the tofu into the tofu Al by one cake unit to widen intervals in a front-rear direction, so that the cakes of the tofu Al are arranged one by one with the widened intervals in the front, rear, left, and right (see JP-A-2014-207901).

Similarly, the cutting means 4 may include the first lateral cutting and distributing means for cutting off the tip end of the continuous sheet-shaped tofu A into a thick band-shaped tofu dough having a width of a plurality of cakes at the rear end of the first transfer conveyor 3, and then, may include the second lateral cutting and distributing means for transferring the thick band-shaped tofu dough to the second transfer conveyor 5, and further cuts the thick band-shaped tofu dough into a thin band-shaped tofu dough having a width of one cake to widen the intervals in the front-rear direction, and thereafter, may include the longitudinal cutting and distributing means for cutting the thin band-shaped tofu dough into the tofu Al by one unit cake to widen the interval in the lateral direction, so that the tofu Al are arranged one cake by one cake with the widened intervals in the front, rear, left, and right.

Operations may be performed in the form of in water, semi-underwater, semi-land, or on land, or may perform all on land by these cutting and distributing means. There is no limitation as long as the means finally transfers the tofu Al one by one on land and arranges the tofu Al with intervals in the front, rear, left, and right.

Positioning means may be used at each cutting to accurately cut the tofu to a desired cutting dimension. In addition, an inversion mechanism may be provided as appropriate to invert only the thick band-shaped tofu dough, the thin band-shaped tofu dough, or the tofu in one unit cake by 180 degrees upside down.

In the related art, in a pack land packaging apparatus in which tofu is dropped into a pack below, since a bottom surface at coagulation molding is smooth, an inversion mechanism for inverting tofu only is provided to direct the bottom surface to a film surface of the pack.

In contrast, in the present invention, the inversion mechanism for inverting the tofu only is not required, and the inversion mechanism is used after the tofu is stored in the pack naturally so that a surface on which a film is applied the bottom surface.

Figure 2:
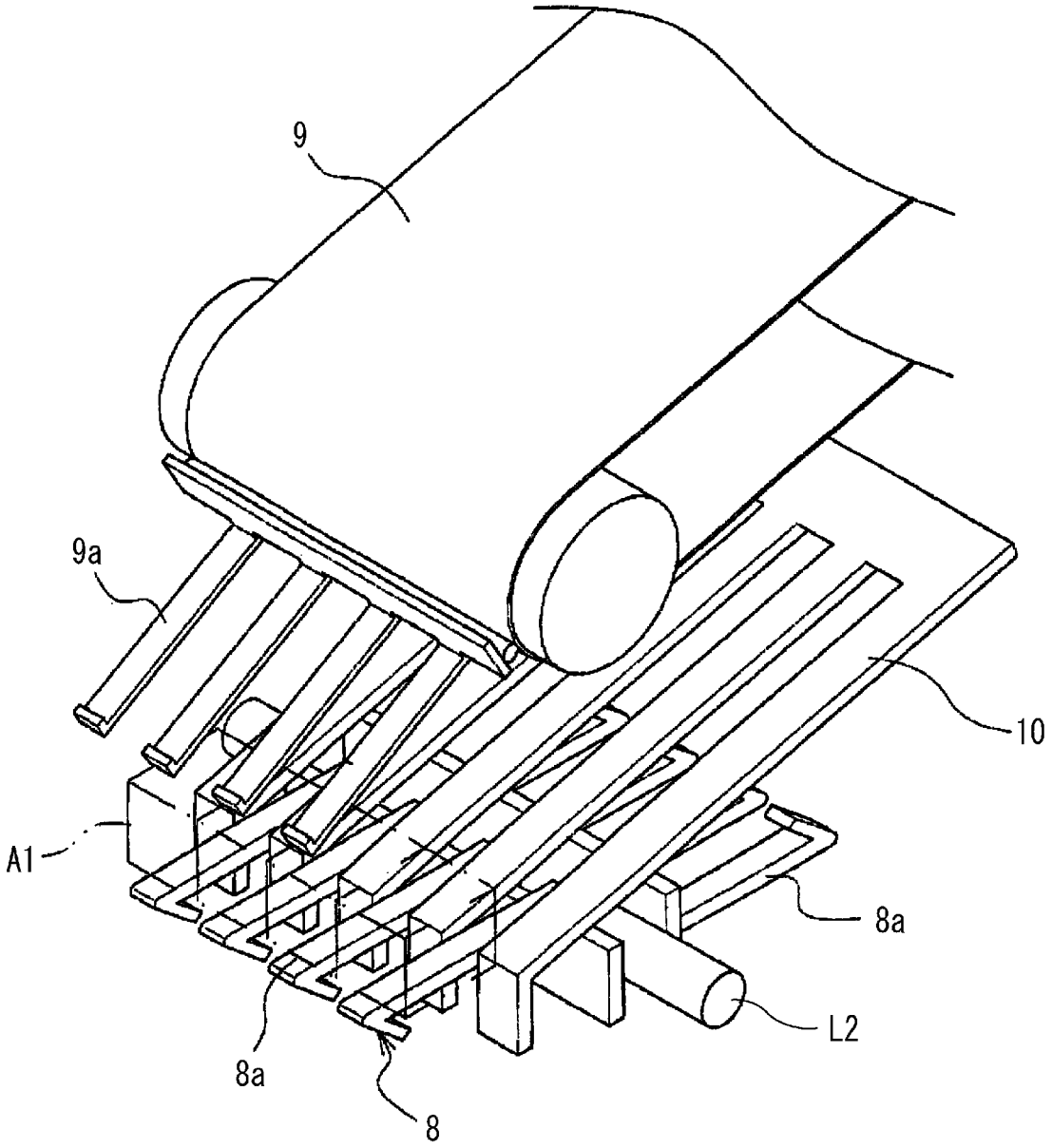
FIG. 2 is a perspective view of a main part of a tofu delivery portion in the tofu packaging apparatus shown in FIG. 1.

In an example shown in FIG. 1, the tofu Al, which is obtained by cutting the continuous sheet-shaped tofu A in water by the cutting means 4, is delivered from the first transfer conveyor 3 side to the second transfer conveyor 5 side by the delivery means 7 for each tofu Al in the foremost lateral row. The delivery means 7 is installed between the first transfer conveyor 3 and the second transfer conveyor 5, and has a rotation plate 8 that receives the tofu Al in the foremost lateral row from the first transfer conveyor 3 side. The delivery means 7 includes a scraper conveyor 9 that is provided above the second transfer conveyor 5, takes over the tofu Al received by the rotation plate 8, and guides the tofu Al to the second transfer conveyor 5. Then, the delivery means 7 includes a guide auxiliary base 10 (see FIG. 2) that is hung between the rotation plate 8 and the second transfer conveyor 5 and assists the scraper conveyor 9 to guide each tofu Al to the second transfer conveyor 5.

The rotation plate 8, which receives the tofu Al in the foremost lateral row and from the first transfer conveyor 3 side, is disposed so that a center of a rotation shaft L2 of the rotation plate 8 is installed near an intersection between the extension line of the first transfer conveyor 3 (the conveyance surface 3*a* thereof) and an extension line of the second transfer conveyor 5 (a conveyance surface 5*s* thereof). The rotation plate 8 has a plurality of blades 8*a* installed at equal intervals. The blades 8*a* have a comb-teeth structure, and can rotate about the rotation shaft L2 without being affected by the scraper conveyor 9 and the guide auxiliary base 10 described below. The number of the blades 8*a* of the rotation plate 8 is two in FIG. 2, but can be about 1 to 6.

The scraper conveyor 9, which takes over the tofu Al received by the rotation plate 8 and guides the tofu Al to the second transfer conveyor 5, is installed above the second transfer conveyor 5 so as to be parallel to the second transfer conveyor 5 (the conveyance surface 5*s* thereof). The scraper conveyor 9 has a plurality of scrapers 9*a* at predetermined intervals, and each scraper 9*a* takes over the tofu Al received from the first transfer conveyor 3 side by the blades 8*a* of the rotation plate 8, and guides the tofu Al to the second transfer conveyor 5. Here, the blades 8*a* of the rotation plate 8 have a comb-teeth structure as described above, but each scraper 9*a* also has a comb-teeth structure having comb teeth corresponding to positions of comb teeth of the blades 8*a*, so that the blades 8*a* and the scrapers 9*a* do not contact with each other.

The guide auxiliary base 10, which initially assists the scraper conveyor 9 to guide the tofu Al from the inside of the water to the land in synchronization with the second transfer conveyor 5, is installed so as to be hung between the rotation plate 8 and the second transfer conveyor 5. The guide auxiliary table 10 serves as a guide path for the tofu Al after the scraper 9*a* of the scraper conveyor 9 takes over the tofu Al from the blade 8*a* of the rotation plate 8, until the scraper 9*a* reaches the second transfer conveyor 5. Here, the guide auxiliary base 10 has a comb-teeth structure having comb teeth corresponding to the positions of the comb teeth of the blades 8*a* of the rotation plate 8, so that even when the blades 8*a* of the rotation plate 8 rotate, there is no possibility that the blades 8*a* and the guide auxiliary base 10 contact each other.

The delivery means 7 (the rotation plate 8, the scraper conveyor 9, and the guide auxiliary base 10) allows smooth delivery of the tofu Al from the first transfer conveyor 3 side to the second transfer conveyor 5 side. That is, of the tofu Al cut in the longitudinal direction and the lateral direction by the cutting means 4, the rotation plate 8 receives the pushed-out tofu Al in the foremost lateral row while rotating the blades 8*a*. Then, each of the received tofu Al in a lateral row is delivered to the scrapers 9*a* of the scraper conveyor 9. Each scraper 9*a* of the scraper conveyor 9 guides each tofu Al along the guide auxiliary base 10 to the second transfer conveyor 5 side. When the rotation plate 8 rotates 180 degrees, the blades 8*a* of the rotation plate 8 receive the tofu Al in the foremost lateral row from the first transfer conveyor 3 side again, and deliver the tofu Al to the scrapers 9*a* of the scraper conveyor 9. Thus, even when the continuous sheet-shaped tofu A is caused to continuously advance into the water tank 2, the cut continuous sheet-shaped tofu A can be smoothly delivered to a packaging line, that is, the second transfer conveyor 5, so that operation efficiency of the entire apparatus 1 can be maintained at a high level.

The second transfer conveyor 5 is provided with staggered arrangement means 11 that temporarily stops the tofu Al in the lateral row, which is longitudinally cut and transferred side by side, in every other column while being transferred to the transfer conveyor 5, so as to widen the interval in the front, rear, left, and right of the tofu Al in staggered arrangement. At least one of the staggered arrangement means 11 is disposed in front of the pack covering device 20 installed on a downstream side of the second transfer conveyor 5, and has a staggered arrangement plate 11*a* rotatably mounted on a rotation shaft 11*c* orthogonal to the traveling direction of the tofu Al. The staggered arrangement plate 11*a* has a comb-teeth structure having a comb tooth in accordance with a left and right width of each tofu Al. Further, an upper end portion of the staggered arrangement plate 11*a* is rotatably connected to a stretchable rod 11*b* (of a drive cylinder).

When each tofu Al in the lateral row is about to pass side by side by the second transfer conveyor 5, the rod 11*a* first contracts upward, and the upper end portion of the staggered arrangement plate 1 connected to this rod 11*a* also moves upward. Accordingly, the staggered arrangement plate 1 rotates about the rotation shaft 11*c* in an upright direction, and each tofu Al in the lateral row is stopped every other column A part of the tofu Al is stopped by the staggered arrangement plate 1 at a position thereof, whereas the other tofu Al that are not stopped advance. Accordingly, the tofu Al, which are previously side by side in the lateral row with the left and right sides almost in close contact with each other, are now arranged in the staggered arrangement with intervals in the front, back, left, and right. Thereafter, the staggered arrangement plate 11*a* is rotated in an opposite direction to that described above, and the tofu Al in the staggered arrangement are transferred to the pack covering device 20 while the arrangement of the tofu Al is maintained.

By the staggered arrangement means 11, the tofu Al that are transferred in a state of being side by side in the lateral row are in the staggered arrangement, so that the tofu Al are spaced apart from each other, and a space for covering the pack P by the pack covering device 20 can be secured, and pack covering can be performed smoothly.

In addition, in the case of manufacturing silken tofu, it is desirable that an auxiliary conveyor 12 is disposed above the second transfer conveyor 5 to assist conveyance of slippery silken tofu.

A hardness (breaking force) of the tofu Al in the present embodiment is 20 gf/cm$^2$ to 200 gf/cm$^2$, more preferably 20 gf/cm$^2$ to 100 gf/cm$^2$, as measured by a breaking force measurement in the vicinity of a rear end of the continuous sheet-shaped tofu A. Then, in the present specification, soft tofu Al refers to tofu in a state of being sagged when being placed on the conveyance surface 5*s* to form a trapezoidal shape in a side view or lean, resulting in distortion, that is, 20 gf/cm$^2$ to 60 gf/cm$^2$, and hardened tofu Al refers to tofu in a state of being placed on the conveyance surface 5*s* to reliably maintain a square state without being distorted, that is, 60 gf/cm$^2$ to 100 gf/cm$^2$ or more. The breaking force measurement is an on-site measurement in a warm state of a core temperature of 50° C. to 80° C. at an outlet of a molding machine or immediately before packaging, and a simple physical property testing device, a portable hardness meter, or a force gauge can be appropriately used. Although depending on manufacturing conditions, the hardness after heating and cooling after packaging is about 1.5 times to 3 times.

Figure 3:
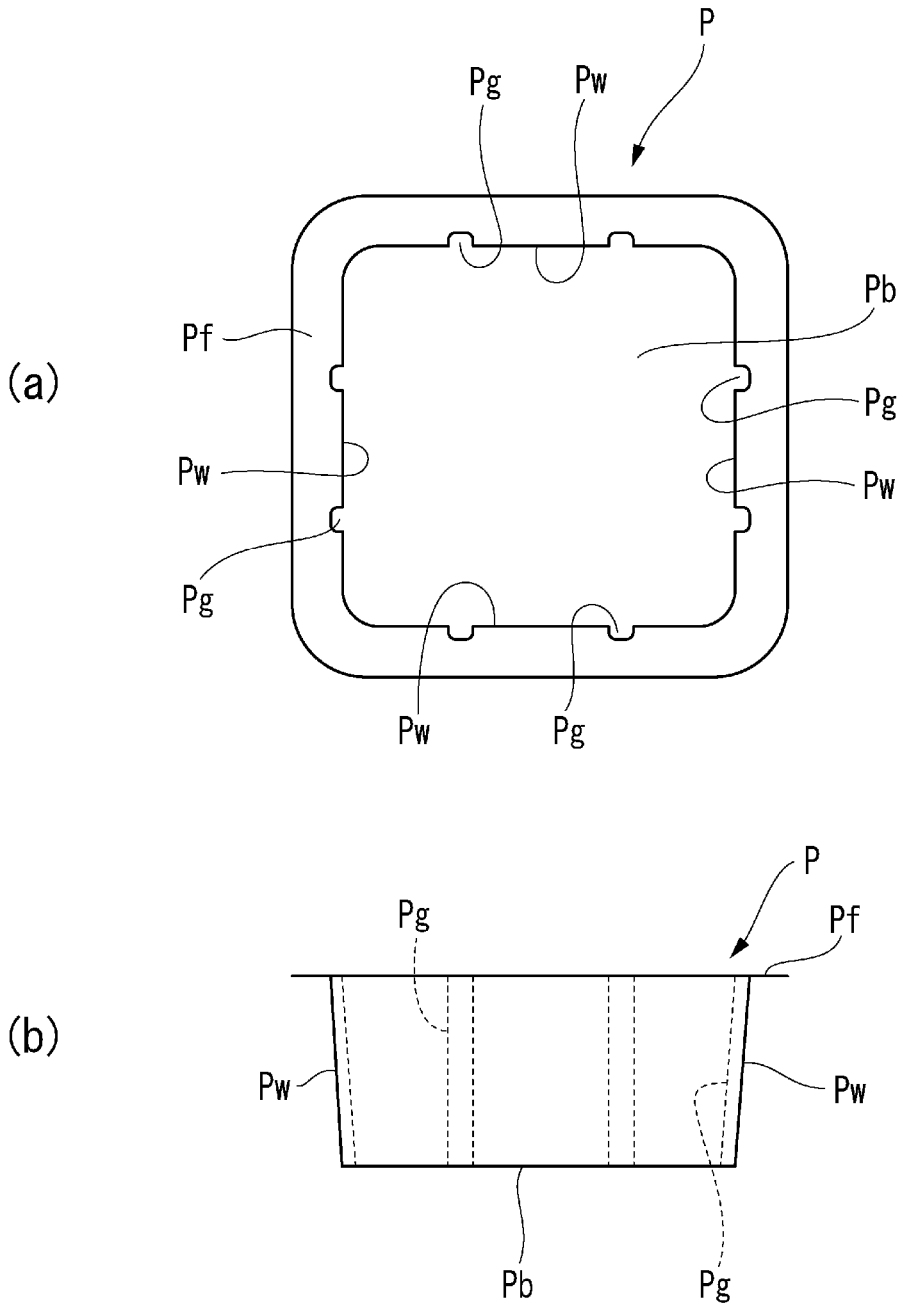
FIG. 3 shows a pack according to the present invention, in which (a) of FIG. 3 is a plan view and (b) of FIG. 3 is a side view.

As shown in FIG. 3, the pack P used in the present embodiment includes a pack flange portion Pf on an opening side opposite to a bottom portion Pb, and a side wall portion Pw has a shape slightly widened from the bottom portion Pb toward the opening side and includes grooves Pg from the bottom portion Pb toward the opening side.

Figure 4:
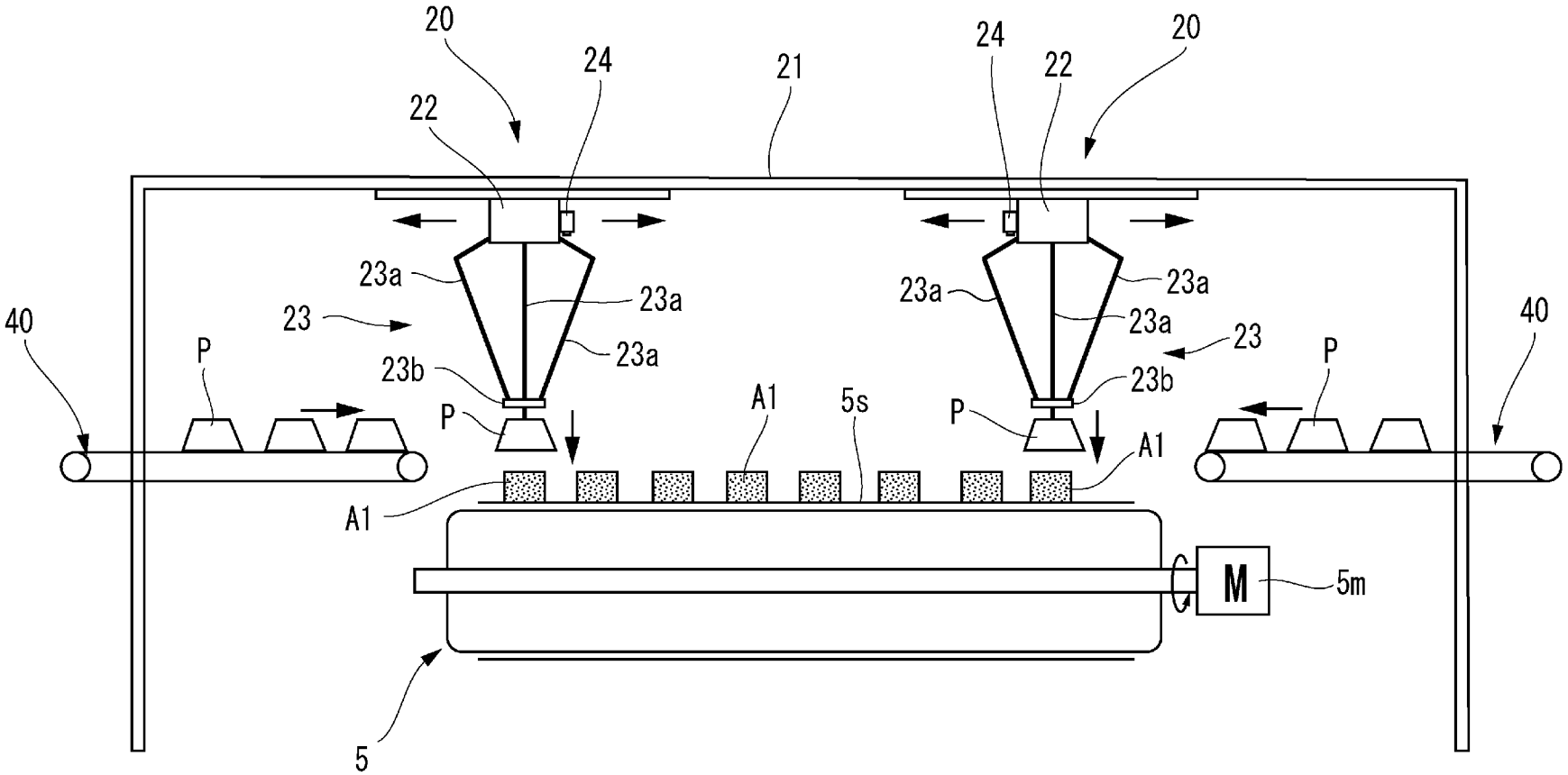
FIG. 4 is a front view of a pack covering device of the tofu packaging apparatus shown in FIG. 1, as viewed from a front side of a transfer conveyor.

The pack covering device 20 covers each tofu Al with the pack P conveyed in the staggered arrangement. As shown in FIG. 4, in the pack covering device 20, a support rail 21 is hung in a conveyor width direction above the second transfer conveyor 5, which is driven by a motor 5*m*. Then, a moving base portion 22 is slidably provided on the support rail 21, and a parallel link mechanism 23 is provided on the moving base portion 22. That is, the pack covering device 20 is a robot including the parallel link mechanism 23 including three link shafts 23*a* that three-dimensionally drive the tip end grip portion 23*b* that grips the pack P. The tip end grip portion 23*b* is not particularly limited as long as the pack can be firmly gripped in the same orientation, in which the tip end grip portion 23*b* can be of an adsorption type in which the pack P is sucked and adsorbed by a suction cup, a chuck type that sandwiches the pack P with forceps of two to four fingers, or further, a gripping structure that combines the adsorption type and the chuck type. The moving base portion 22 and the tip end grip portion 23*b* may also be provided with a horizontal rotation shaft or a vertical rotation shaft, and may be provided with a control shaft having a total of 4 to 6 degrees of freedom. In addition, a parallel link mechanism is preferable, but in addition to the parallel link mechanism, a SCARA robot may be used, as long as the SCARA robot is a high-speed robot capable of operating 100 reciprocations (cycles) or more per minute (100 CPM; abbreviation for cycle per minute) over a horizontal distance of 200 mm to 300 mm. It is more preferable that the SCARA robot is a high-speed robot capable of operating 100 reciprocations or more per minute (100 CPM; abbreviation for the cycle per minute) over a horizontal distance of 0.5 m to 1.5 m.

The support rail 21 may be used to surround the transfer conveyor 5 and the robot with a cover to prevent danger, prevent foreign matter from entering, and perform automatic cleaning having a cleaning function inside of the cover. In addition, the robot installed above the tofu is preferably a robot having a hygienic specification for food factories, such as a dustproof specification that prevents grease or foreign matter from falling, or a waterproof specification that allows the robot itself to be washed with water or cleaned with a chemical solution (CIP cleaning). In terms of an IP standard, the pack covering device 20 supports IP54 or greater, and preferably IP65 or greater. In the related art, the robot itself is installed in a form of being covered with a cover, but the cover itself may be deteriorated and damaged to cause the foreign matter to enter.

The pack covering device 20 includes an image sensor 24 (camera device) on the moving base portion 22 that captures an image of each tofu Al flowing on the conveyance surface 5*s*. The pack P can accurately cover each tofu Al in accordance with a position of each tofu Al imaged by the image sensor 24. Although not shown in the drawings, an illumination member for the image sensor 24 may be provided as appropriate.

An image of the tofu Al is analyzed based on a detection signal from the image sensor 24. Therefore, in response to detection of an abnormality of the tofu Al based on the image analysis, a processing is performed so that the tofu Al is not covered with the pack P.

As used herein, the abnormality of the tofu Al is referred to, for example, detection of the tofu Al having a small size (cutting dimension), the tofu Al cut and deformed into a trapezoidal shape or a rhombus shape, the tofu Al collapsed or chipped, the tofu Al having a large number of air bubbles in a cut surface, or having foreign matter adhering thereto. In addition, by performing an image analysis on an image signal immediately before each tofu Al on the second transfer conveyor 5, even if there is the tofu Al that is slightly displaced, a covering position of the pack P by the tip end grip portion 23*b* with respect to the tofu Al is corrected, and the pack covering is accurately performed.

An image of the pack P is also analyzed based on a detection signal from a second image sensor 25. Therefore, when an inclination or abnormality of the pack P is detected based on the image analysis, a processing is performed so that the pack P is not gripped. As used herein, the abnormality of the pack P is referred to, for example, the pack P being deformed, overlapped, flipped, or different in size, or the pack P being adhered with foreign matter. In addition, by performing an image analysis on an image signal immediately before each pack P on a pack supply conveyor 40, even if there is the pack P having a slightly poor posture or displaced, a gripping position of the pack P by the tip end grip portion 23*b* with respect to the pack P is corrected, and pack P is accurately gripped. The image sensor 24 and the image sensor 25 may be the same or may be provided separately. In addition, it is preferable that one image sensor is provided for one robot, or one image sensor for the pack P and two image sensors for the tofu A are provided, and the number of robots, the number of image sensors, and a correspondence therebetween are not particularly limited.

In addition, two pack covering devices 20 are installed on right and left sides in the conveyor width direction. Therefore, operation areas of the two pack covering devices 20 are divided into two in a conveyor left-right width direction. Here, a horizontal movement range of the pack covering device 20 is set, for example, in a range of 0.5 meter to 1.5 meters because an arrangement width of the tofu Al is in a range of 1.0 meter to 3.0 meters, and an operation accuracy is within ±2.0 millimeters, preferably within ±0.2 millimeters, and more preferably within ±0.02 millimeters.

The pack P is supplied by pack supply conveyors (pack supply devices) 40 provided on two sides of the second transfer conveyor 5 in the width direction. It is preferable that the same number of pack supply conveyors 40 as the number of pack covering devices 20 is provided, that is, a ratio of the number of pack covering devices 20 to the number of pack supply conveyors 40 is 1:1. However, the number of pack covering devices 20 and the number of pack supply conveyors 40 may be provided in a ratio of 1:2, 1:3, 2:1, 3:1, or the like. Since one pack supply conveyor 40 is provided with at least one pack supply magazine that stocks a large number of empty packs, an operator who supplies the empty packs can concentrate on the one magazine and reduce burden. Once the magazine is replenished to a certain extent, the pack supply means on an opposite side can be replenished with the pack P or other operations can be performed for a while.

Figure 5:
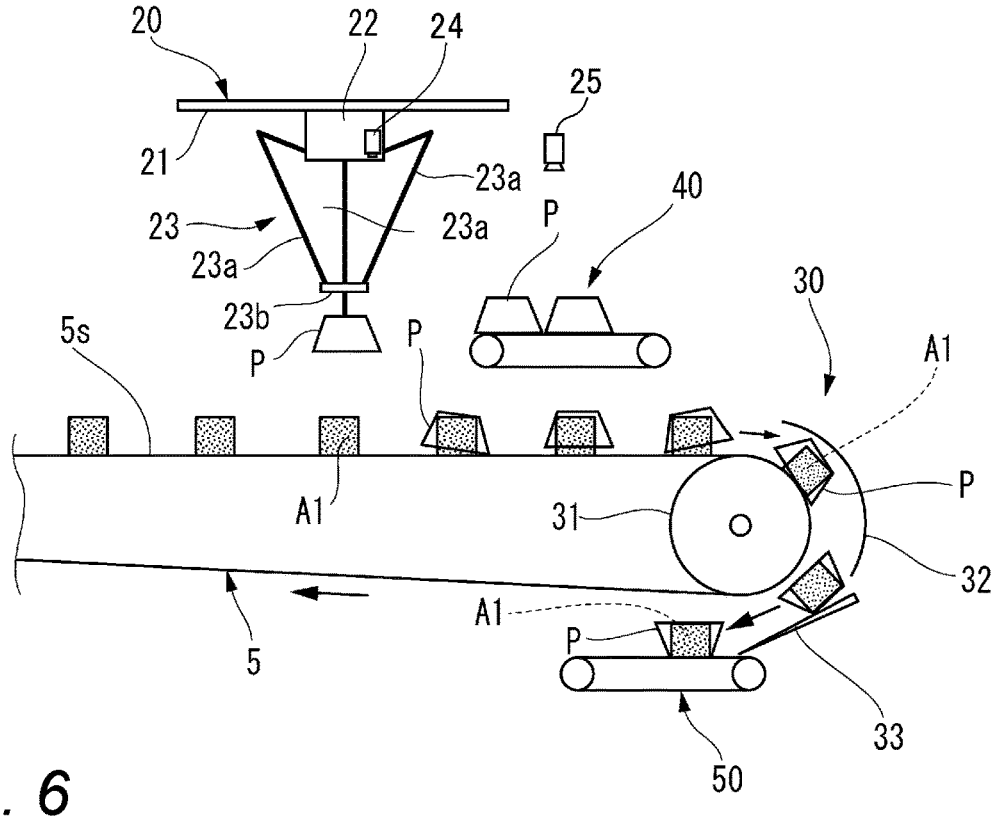
FIG. 5 is an enlarged side view of a main part of the tofu packaging apparatus shown in FIG. 1, and is a side view showing a state in which the pack is positioned on an upper side of tofu that is sufficiently smaller than the pack.

Although the pack supply conveyor 40 shown in FIG. 4 is illustrated to supply the pack P in the conveyor width direction (a direction orthogonal to the second transfer conveyor 5), the pack supply conveyor 40 may extend so as to cover an upper side of the second transfer conveyor 5, or may straddle the second transfer conveyor 5. In addition, the pack supply conveyor 40 may be configured to supply the pack P along a conveying direction of the pack P of the second transfer conveyor 5, as shown in FIG. 5 and subsequent drawings. In addition, the pack P is fed to substantially the same height as a drop start position of the pack P. That is, it is advantageous to supply the tofu Al horizontally at the shortest distance along the conveying direction of the tofu Al of the second transfer conveyor 5 without moving up and down. In addition, it is more efficient and desirable to consider a case where a plurality of packs P are simultaneously gripped.

In addition, (the robot of) the parallel link mechanism 23 and (the robot of) the SCARA mechanism (not shown) of the present embodiment are desirably robots having a high-speed processing capacity (capacity capable of driving at high speed) of 100 reciprocations (100 CPM) or more in a horizontal reciprocation over a horizontal distance of, for example, 0.2 m to 3 m, preferably 0.5 m to 1.5 m. As used herein, the high-speed processing is referred to a processing capacity of 4000 cakes to 6000 cakes or more per hour with one pack covering device 20. If there are two units, three units, and four units, the processing capacity is twice, three times, four times, and so on. In the unlikely event, it is preferable to have a margin in terms of the number of robots and the processing capacity so that even when one robot fails, the other robots can compensate. In this case, the moving base portion 22 is adjusted so that even if one of the robots fails, arrangement of remaining robots can be adjusted so as to fall within an operating range regardless of where the pack P or the tofu A is positioned. A multi-joint (serial link mechanism) robot may be used as long as the multi-joint robot can process at the same high speed or higher.

The inversion device 30 includes an inversion support portion 31 that is a roller configured to invert the conveyance surface 5*s* of the second transfer conveyor 5; an arc-shaped pack holding portion 32 disposed along the conveyance surface 5*s* positioned on the inversion support portion 31 and holding the pack P until the pack P is inverted; and a connection chute 33 that discharges the inverted pack P at a downstream end of the pack holding portion 32. The pack P discharged by the connection chute 33 is transferred to a next processing step (packaging step) by a third transfer conveyor 50.

Operations of the pack covering device 20 and the inversion device 30 will be described.

In a following description, a case where the tofu Al is smaller than a size of the pack P (FIGS. 5, 6, and 7, a case where there is a gap of 5 mm or more from a pack inner dimension), a case where the tofu Al is larger than the size of the pack P (FIG. 8, a case where there is a gap of less than 5 mm from the pack inner dimension), a case where the tofu Al is slightly sagged and soft (FIG. 9, the breaking force of the tofu is 60 gf/cm$^2$ to 100 gf/cm$^2$), and a case where the tofu is soft and largely sagged (FIG. 10, the breaking force of the tofu is 20 gf/cm$^2$ to 60 gf/cm$^2$) will be described.

First, an overall operation of the pack covering device 20 will be described.

When each tofu Al arranged at predetermined intervals on the conveyance surface 5*s* flow to a vicinity of the pack covering device 20, the tofu Al covered with the pack P is detected by the image sensor 24, and the tip end grip portion 23*b* of the pack covering device 20 is driven in accordance with a position of the tofu Al based on detection information.

In the pack covering device 20, the moving base portion 22 moves to a pack supply conveyor 40 side, and the pack P is gripped by the tip end grip portion 23*b* while the pack P is in a reversed state (a state in which an opening of the pack P faces downward). Thereafter, as shown in FIG. 5, the moving base portion 22 is moved so as to approach directly above the tofu Al, and the pack P is positioned substantially directly above the tofu Al. When an operating range of the tip end grip portion 23*b* of the pack covering device 20 is sufficiently wide, the moving base portion 22 can be omitted.

Figure 6:
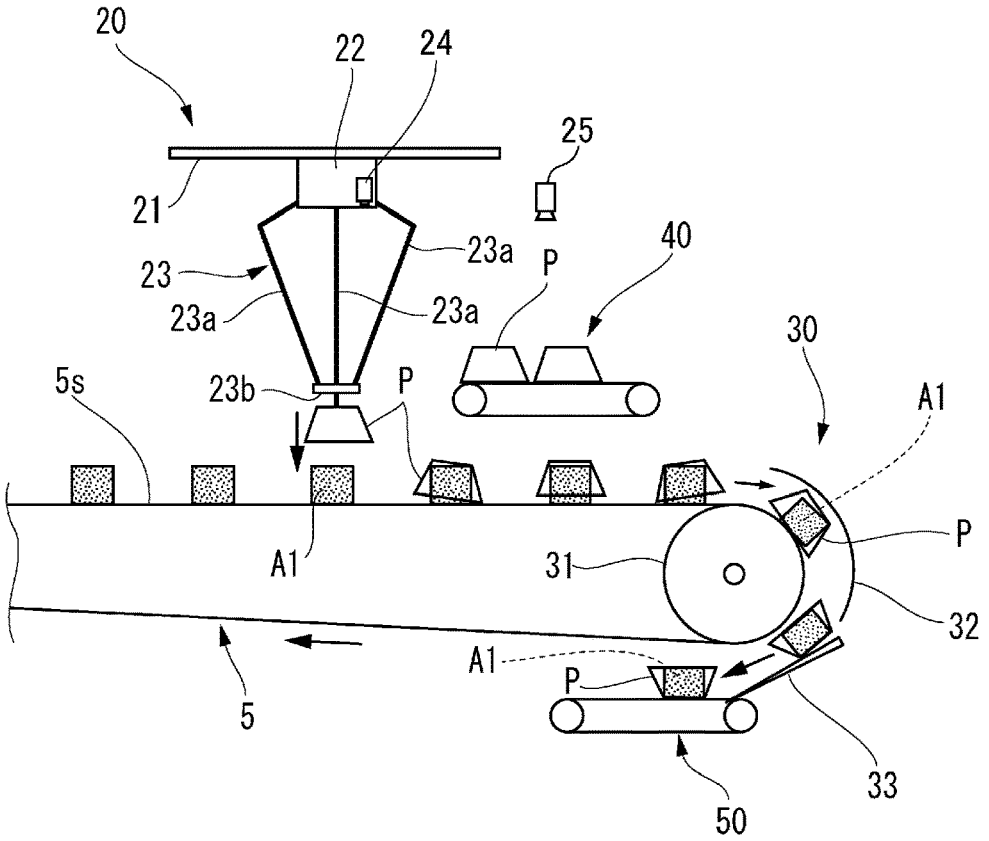
FIG. 6 is an enlarged side view of a main part of the tofu packaging apparatus shown in FIG. 1, and is a side view showing a state in which the pack approaches the upper side of the tofu that is sufficiently smaller than the pack.
Figure 7:
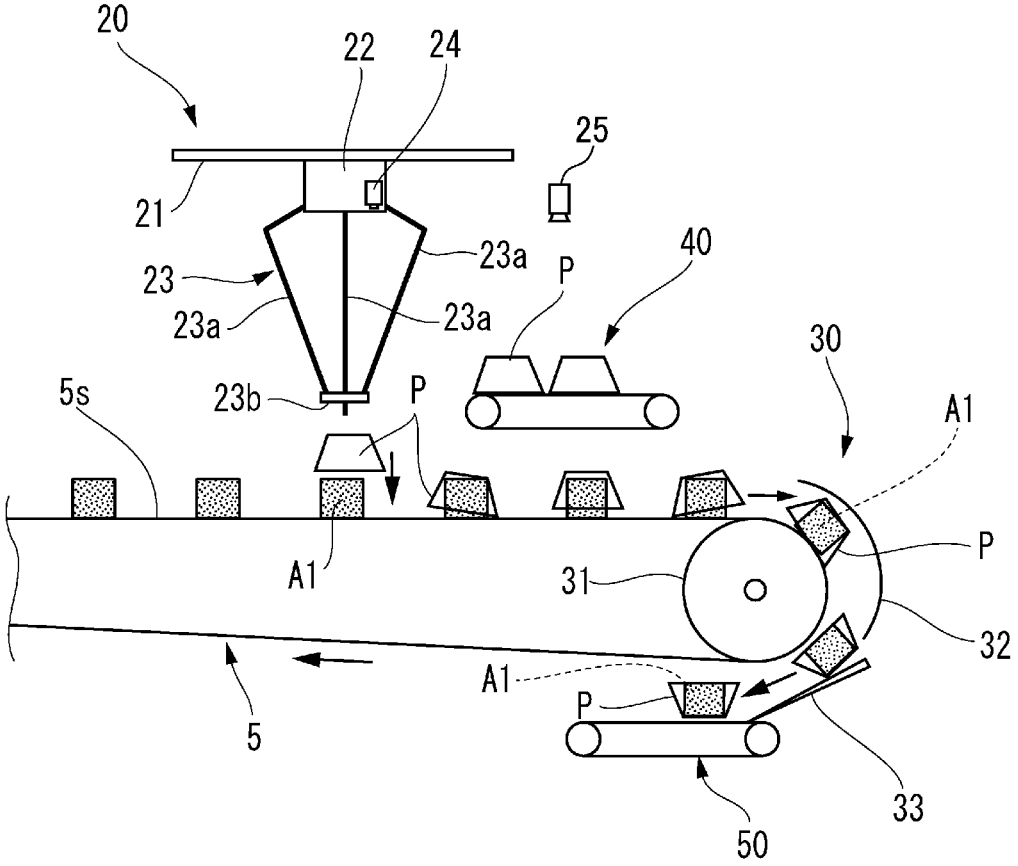
FIG. 7 is an enlarged side view of a main part of the tofu packaging apparatus shown in FIG. 1, and is a side view showing a state in which the tofu that is sufficiently smaller than the pack is covered with the pack.

Thereafter, as shown in FIG. 6, the parallel link mechanism 23 is driven to extend to bring the pack P close to an upper side of the tofu Al. Following this operation, as shown in FIG. 7 (the similar applies to FIGS. 8, 9, and 10), gripping of the pack P by the tip end grip portion 23*b* is released, and the pack P is dropped. At this time, the pack P does not forcibly press against the tofu Al, but gently drops due to its own weight to cover the tofu Al.

Next, a case where the tofu Al is smaller than the size of the pack P will be described.

In this case, when the pack P is dropped from directly above the tofu Al, the pack P covers the tofu Al so as to float from the conveyance surface 5*s*, or the pack P slightly floats so as to be slightly caught is slightly inclined, or one end of the pack P contacts the conveyance surface 5*s*. That is, as shown in FIGS. 5 to 7, a state in which the pack P is placed flat on the tofu Al or a state in which the pack P is obliquely inclined on the tofu Al in the front, rear, left, and right to cover the tofu Al occurs.

Figure 8:
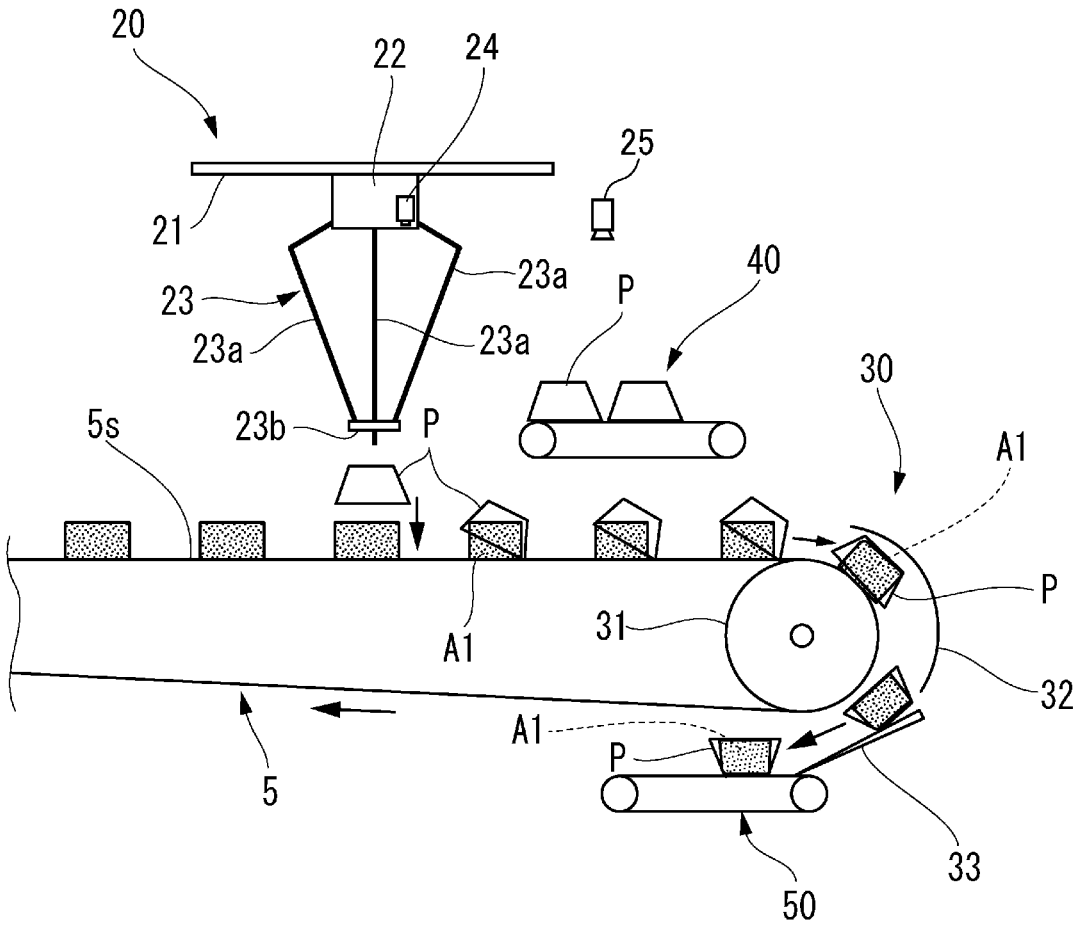
FIG. 8 is an enlarged side view of a main part of the tofu packaging apparatus shown in FIG. 1, and is a side view showing a state in which the tofu is covered with the pack.

Next, a case where the tofu Al is larger than the size of the pack P (the gap between the pack and the tofu is less than 5 mm) will be described with reference to FIG. 8.

In this case, even the pack is directly above the tofu Al, the pack P is slightly dropped from the downstream side. As a result, an upstream side of the pack P is caught on an upstream end of the tofu Al. Therefore, the pack P covers in an inclined state with the upstream side of the pack P is in a floated appearance. In some cases, as shown in FIG. 8, a downstream end of the pack P contacts the conveyance surface 5*s*.

Next, a case where the tofu Al is slightly sagged and soft (60 gf/cm$^2$ to 100 gf/cm$^2$) will be described with reference to FIG. 9.

In this case, since the tofu Al is slightly larger on a lower side, when the pack P is dropped from directly above the tofu Al, the pack P may be slightly inclined, but almost all packs P are in a state of covering the tofu Al floating from the conveyance surface 5*s*.

Figure 10:
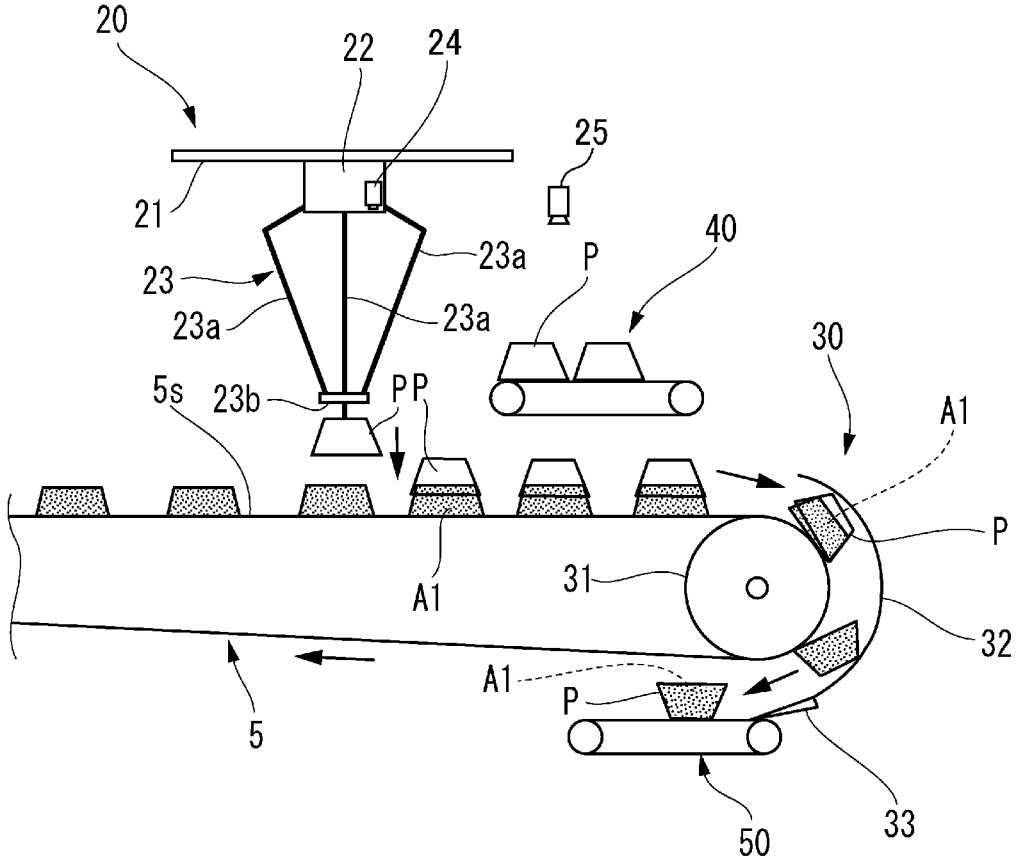
FIG. 10 is an enlarged side view of a main part of the tofu packaging apparatus shown in FIG. 1, and is a side view showing a state in which the tofu is covered with the pack.

Next, a case where the tofu Al is soft and largely sagged (20 gf/cm$^2$ to 60 gf/cm$^2$) will be described with reference to FIG. 10.

Figure 9:
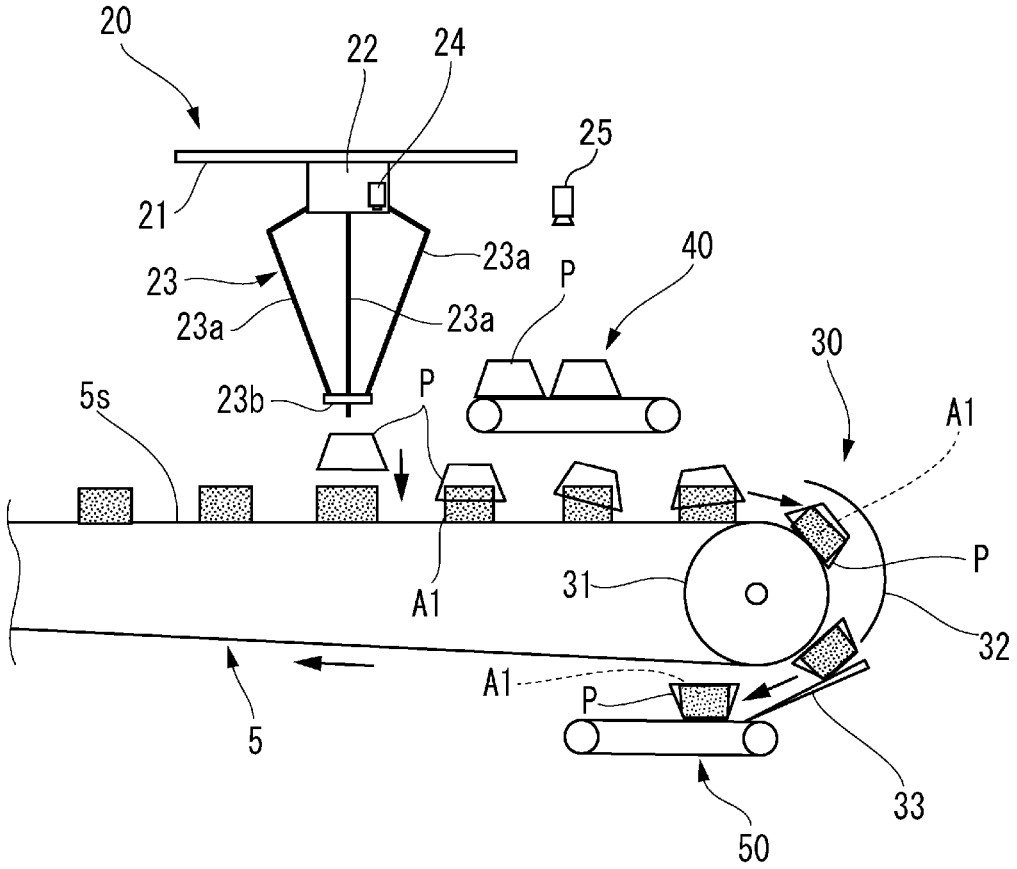
FIG. 9 is an enlarged side view of a main part of the tofu packaging apparatus shown in FIG. 1, and is a side view showing a state in which the tofu is covered with the pack.

In this case, the tofu Al has a large sag on the lower side, is flat as a whole, and has a considerably large planar size (larger than that in FIG. 9). Therefore, when the pack P is dropped from directly above the tofu Al, the pack P may be slightly inclined, but as shown in FIG. 10, almost all the packs P are in a state of covering the tofu Al in a largely floating appearance.

As described above, in the present embodiment, the tofu Al is covered with the pack P under various conditions of the hardness of the tofu Al, but in either case, the tofu Al is transferred to the inversion device 30 in a state where the tofu Al is covered with the pack P halfway.

Next, the inversion device 30 will be described.

In the inversion device 30, the pack P rises from a horizontal posture to a vertical posture in a state where the bottom portion Pb is held by the pack holding portion 32, and continues to be inverted and becomes in the horizontal posture again. At this time, the bottom portion Pb of the pack P is always held while the pack P is moving, while a position of the tofu Al in the pack P on the opening side of the pack P is restricted by the conveyance surface 5*s*. Therefore, the tofu Al falls downward (moves downward) in the pack due to gravity. Accordingly, most of the air accumulated between the pack P and the tofu Al is quickly discharged to an outside along the side wall portion Pw and the groove Pg on an upper side of the pack P. As a result, the tofu Al is quickly stored in the pack P.

The pack P accommodating the tofu Al and inverted thus wraps around below a belt of the second transfer conveyor 5, is conveyed to a packaging machine (not shown) with the opening side of the pack P facing upward, and is sealed with a film.

As described above, in the packaging apparatus 1 according to the present embodiment, since the pack covering device 20 covers the tofu Al with the pack P halfway by the tip end grip portion 23*b*, it is possible to reduce damage to the tofu Al when being covered with the pack and to avoid damage to the tofu Al. Further, in the inversion device 30, the tofu Al covered with the pack P is inverted upside down and stored in the pack without applying a force to the tofu Al, so that in a process of changing the tofu Al from a horizontal posture to a vertical posture in a state where the tofu Al is contained in the pack P, air in a space sandwiched between the pack P and the tofu Al is released well, and the tofu Al can be smoothly stored in the pack P without difficulty without causing collapse of the tofu Al.

In addition, the pack covering device 20 according to the present embodiment includes the parallel link mechanism 23 configured to drive the tip end grip portion 23*b* that grips the pack P three-dimensionally at high speed or the SCARA mechanism (not shown), and thus has a high-speed processing capacity of 100 CPM or more, and can cover and store warm and soft tofu having a breaking force of 20 gf/cm$^2$ to 100 gf/cm$^2$ with the pack P at an extremely high speed and with high accuracy. Therefore, although a limit is 3,000 cakes/hour in the related art, a packaging number of the tofu Al can be dramatically increased to, for example, 4,000 cakes/hour to 12,000 cakes/hour or more.

In the present embodiment, the inversion device 30 includes the inversion support portion 31 configured to invert the conveyance surface 5*s* and the pack holding portion 32 disposed along the conveyance surface 5*s* on the inversion support portion 31 and holding the pack P until the pack P is inverted, so that the pack P accommodating the tofu Al can be inverted while being held on the conveyance surface 5*s*, and the tofu Al can be stored in the pack while being conveyed.

In the present embodiment, the image sensor 24 capable of detecting the state of the tofu Al is provided, so that a position, shape, and the like of the tofu Al can be measured and monitored, and speed and accuracy of packaging can be improved based on detection information of the image sensor 24.

In the present embodiment, when the image of the tofu Al is analyzed by the image sensor 24 and the abnormality of the tofu Al is detected, the tofu Al is not covered with the pack P, so that unnecessary operations can be reduced, workability can be increased, and a yield can be improved. As a result, an inspection operation in a subsequent step can be reduced, and quality of a product can be improved.

Since the pack covering device 20 according to the present embodiment is provided on both the left and right sides in the width direction of the conveyance surface 5*s*, an area to be covered with the pack P can be divided into two in left and right directions of the conveyance surface 5*s*, and an operation range of the pack covering device 20 can be reduced, and a pack covering operation can significantly speed up. As a matter of course, the pack covering device 20 may be disposed only on one side even if a capacity is slightly reduced.

In the pack covering device 20 according to the present embodiment, since the tofu has the hardness (breaking force) of 20 gf/cm$^2$ to 100 gf/cm$^2$, and preferably 30 gf/cm$^2$ to 80 gf/cm$^2$ as a hardness at the outlet of the molding machine in a warm state, so that even when the tofu Al is soft, easily sagged, and easily damaged, the tofu Al can be packaged quickly and accurately.

Since the pack P in the present embodiment has the groove Pg extending at least from the bottom portion Pb toward the opening side on the inner surface of the pack, when the tofu Al and the pack P are inverted in a state where the tofu Al is covered with the pack P and the air sandwiched between the pack P and the tofu Al is released, the groove Pg functions as an air release path, and the air is released quickly. As a result, the tofu Al can be stored in the pack P quickly and smoothly without difficulty.

In the related art, when the tofu Al is dropped into the pack P, the gap between the tofu Al and the pack P needs to be about 5 millimeters to 10 millimeters, but in the present embodiment, the air can be easily released, so that a dimensional difference between the tofu Al and the pack P can be reduced to less than 5 millimeters. According to the present embodiment, this dimensional difference can be dramatically reduced from 5 millimeters to 10 millimeters to 1 millimeter to 4.9 millimeters. In addition, accordingly, the tofu Al can be more reliably held by the pack P, and a size of the pack P can be reduced.

Second Embodiment

Hereinafter, the second embodiment of the present invention will be described with reference to FIGS. 11 and 12.

Figure 11:
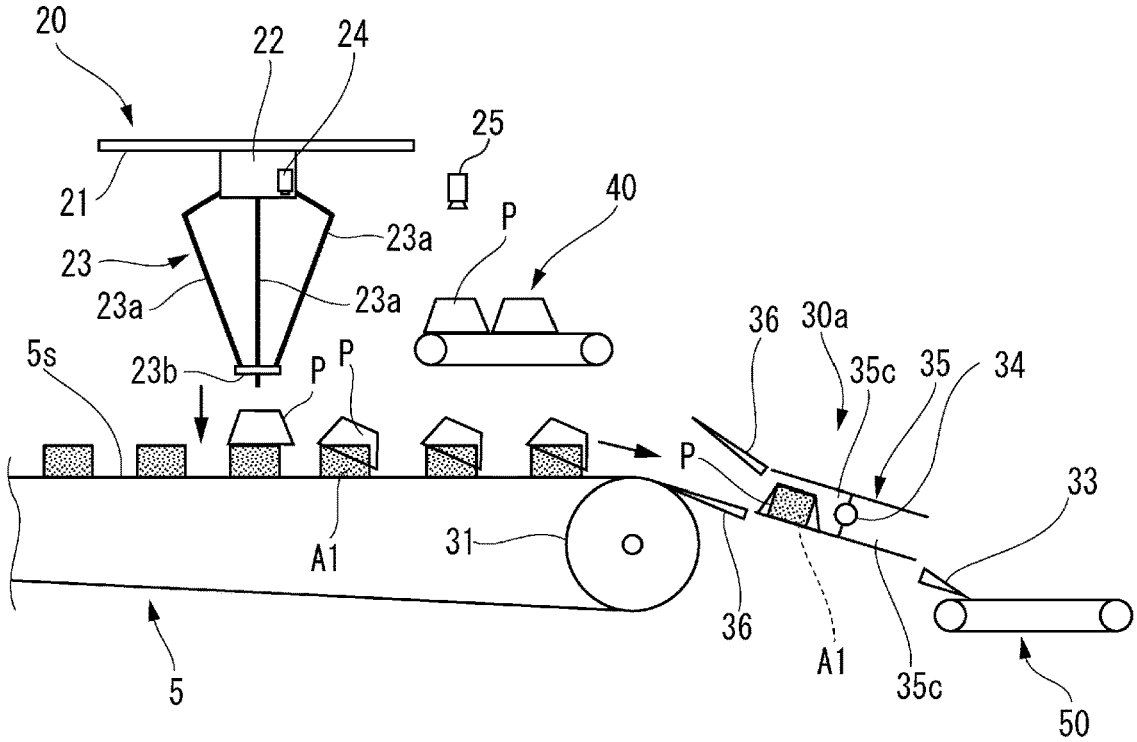
FIG. 11 is a schematic side view showing a main part of the tofu packaging apparatus according to a second embodiment of the present invention.
Figure 12:
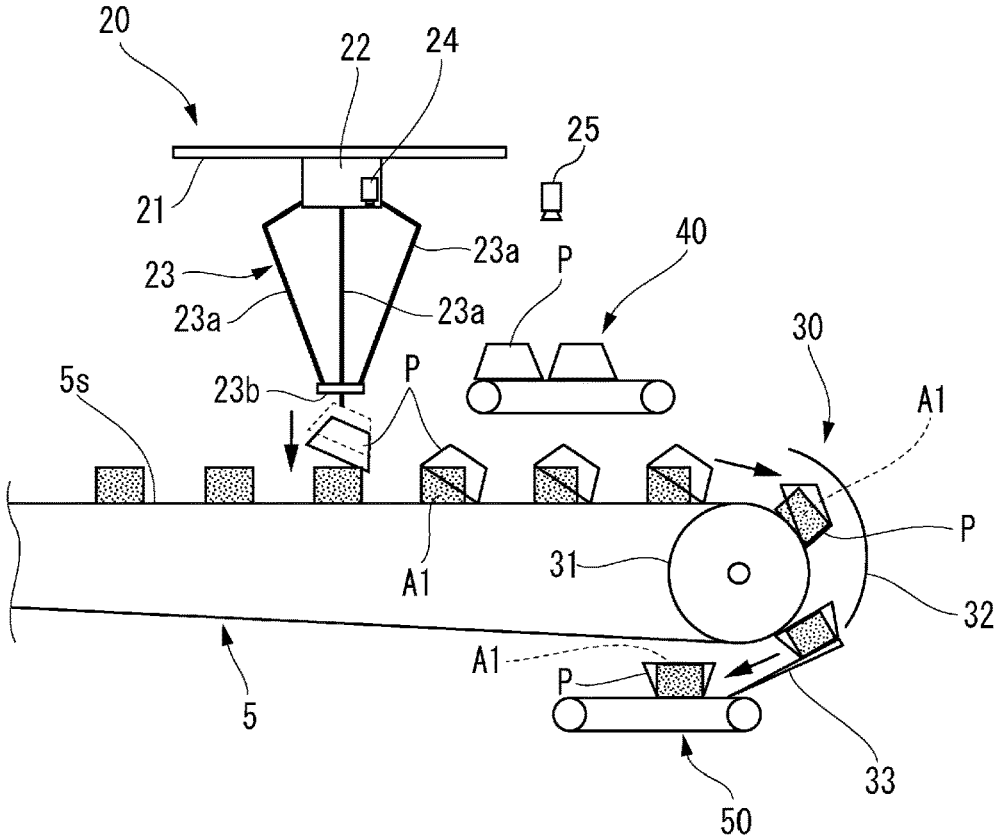
FIG. 12 is a schematic side view showing a main part of the tofu packaging apparatus according to the second embodiment of the present invention.

FIG. 11 shows a soft and sagged tofu Al, and FIG. 12 shows a hard tofu. In FIGS. 11 and 12, the same components as those of the first embodiment are denoted by the same reference signs, and description thereof is omitted.

The pack covering device 20 in the present embodiment is different from that of the first embodiment in that the pack P covers the tofu Al in a posture with the downstream side of the pack down and the upstream side of the pack up. That is, even in the first embodiment, a state with the downstream side of the pack P down may occur accidentally, but in a case of the present embodiment, all the packs P are always in a posture with the downstream side down and the upstream side up.

First, the soft and sagged tofu Al shown in FIG. 11 will be described. In this case, after the pack P is gripped by the tip end grip portion 23*b*, the tip end grip portion 23*b* is inclined by the parallel link mechanism 23. Therefore, the pack P is positioned substantially directly above the tofu Al in a state where the orientation of the pack P is inclined by a predetermined amount. At this time, a front-rear position (upstream-downstream position) of the pack P is positioned on the downstream side with respect to the tofu Al. Then, grip of the pack P is released and the pack P is dropped. Here, since the tofu Al is sagged so as to be slightly larger on a lower side, the downstream end of the pack P covers the tofu Al so as to be positioned at or near a downstream end of the tofu Al. As a result, the pack P is considerably floating on the tofu Al, and the entire pack P is separated from the conveyance surface 5*s* or a part of the pack P is in contact with the conveyance surface 5*s*, but a covering manner of the pack P on the tofu Al is that all the packs P are in the posture with downstream side down and the upstream side up. Since the pack P and the tofu Al are received by the inversion device 30 and a gap between the inversion support portion 31 and the inversion device 30 is formed as a narrowing passage, in the vicinity of the vertical posture of the pack P and the tofu Al, a gap is formed between the pack P and the tofu Al on the upper side (upstream side) while sagging of the tofu is biased to the lower side (downstream side), and the upstream side of the pack P is deeply covered on the upstream side of the tofu Al. Thus, the tofu Al is almost completely with the pack P from the downstream side to the upstream side of the tofu Al, and the inversion of the pack P is completed.

Next, the hard tofu Al shown in FIG. 12 will be described.

This case is exactly the same as the case shown in FIG. 11 except that the covering manner of the pack P is slightly different. That is, when the tofu Al is hard, the tofu Al does not sag, so that a lower portion of the tofu Al does not largely swell. As a result, as shown in FIG. 12, the pack P covers so that an opening end on the downstream side of the pack P is always in contact with the conveyance surface 5*s*.

In the present embodiment, the inversion by the inversion device 30 after the pack P covers is the same as that in the first embodiment.

As described above, the pack covering device 20 in the present embodiment can always cover the tofu Al with the pack P in the same state in a posture with the downstream side of the pack P down and the upstream side of the pack P up. As a result, since the pack P always covers the tofu Al with the downstream side inclined downward, the tofu Al at the time of inversion is obliquely inserted into the pack P from the downstream side to the upstream side, and residual air between the pack P and the tofu Al is smoothly discharged. As a result, the packaging can speed up. In this embodiment, it is not always necessary that the gap between the inversion support portion 31 and the inversion device 30 is formed as the narrowing passage. In addition, the tofu Al may not be covered with the pack P with high accuracy, and the pack P may not be inclined, but the tofu Al may be covered with the pack P shifted to the downstream side, and the pack P that covers horizontally or the pack P that covers obliquely may be mixed.

Third Embodiment

Hereinafter, the third embodiment of the present invention will be described with reference to FIGS. 13 and 14.

Figure 13:
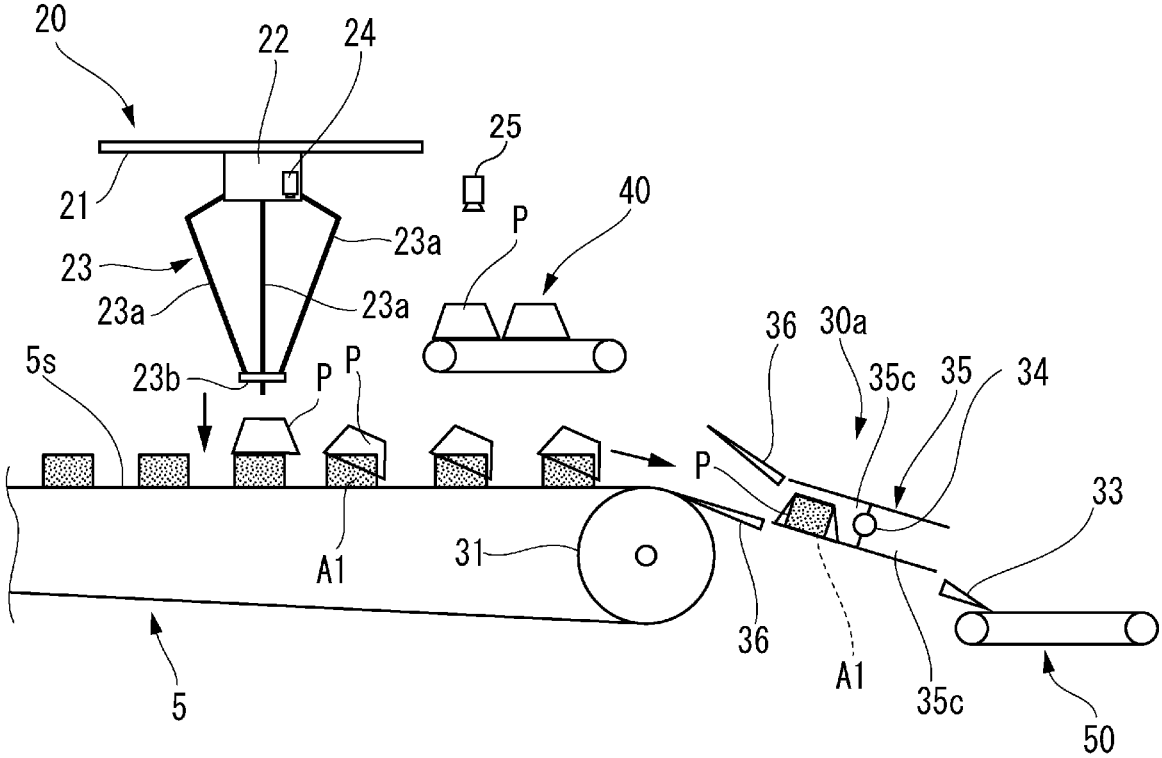
FIG. 13 is a schematic side view showing a main part of the tofu packaging apparatus according to a third embodiment of the present invention, and is a schematic side view showing a state in which an inversion device receives the pack.
Figure 14:
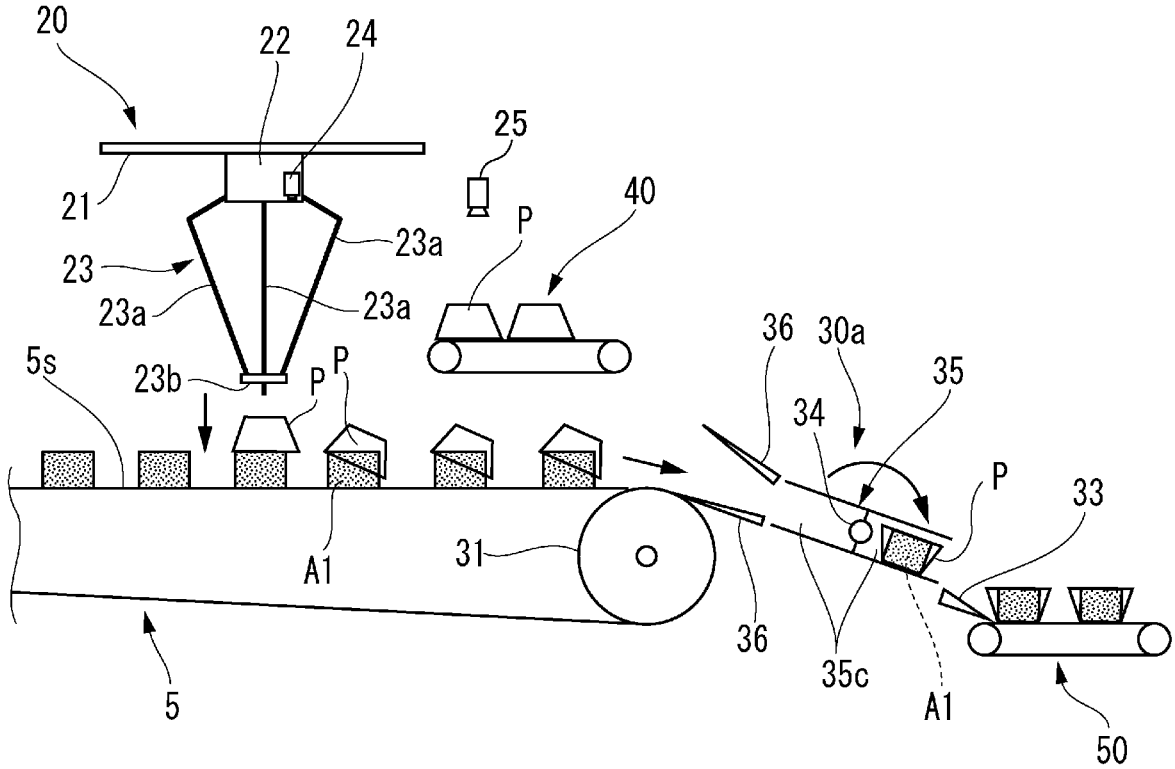
FIG. 14 is a schematic side view showing a main part of the tofu packaging apparatus according to the third embodiment of the present invention, and is a schematic side view showing a state in which the inversion device inverts the pack.

In FIGS. 13 and 14, the same components as those of the first embodiment are denoted by the same reference signs, and description thereof is omitted.

As shown in FIG. 13, an inversion device 30*a* according to the present embodiment includes the inversion support portion 31 configured to invert the conveyance surface 5*s*; a pack holding portion 35 provided at a position facing the inversion support portion 31, the pack holding portion 35 being configured to accommodate and hold the tofu Al covered with the pack P and slid from the conveyance surface 5*s* to accommodate the tofu Al, and rotationally move until the pack P is inverted upside down; a chute portion 36 configured to put the tofu Al from the conveyance surface 5*s* into the pack holding portion 35; and a connection chute 33 configured to feed the inverted pack P from the pack holding portion 35. The chute portion 36 includes an upper plate and a lower plate, and serves as the narrowing passage so as to allow the tofu Al, that has covered halfway with the pack P, to be covered with the pack P more deeply from a receiving side toward a discharging side. Then, the pack holding portion 35 includes a rotation shaft 34 on a downstream side of the chute portion 36, and has two pack accommodating portions 35*c* that receive the tofu Al from the chute portion 36 and accommodate the tofu Al. The lower plate of the chute portion 36 has a downward gradient such that the tofu Al covered with the pack P easily slides. The lower plate of the chute portion 36 may be provided with a large number of small holes for ejecting water or air to reduce frictional resistance, or a water sprinkling device that sprinkles water as appropriate from above may be provided. In addition, when the lower plate of the chute portion 36 extends in nearly a horizontal direction, the two pack accommodating portions 35*c* may be configured in a comb blade shape, a pushing device may be separately provided to perform pushing and feeding operations so as to engage with a comb blade feeding plate.

In the inversion device 30*a* configured thus, first, the tofu Al covered with the pack P halfway from the second transfer conveyor 5 is covered with the pack P more deeply via the chute portion 36, and the tofu Al is accommodated in the pack holding portion 35.

Thereafter, as shown in FIG. 14, the pack holding portion 35 rotates in a clockwise direction in the figure with the rotation shaft 34 as a fulcrum while holding the tofu Al covered by the pack P. By this rotation, the pack P is inverted upside down in a state of being held by upper and lower wall surfaces of the pack accommodating portion 35*c*. Thereafter, the inverted pack P is transferred to a third transfer conveyor 50 side via the connection chute 33. On the other hand, the other pack accommodating portion 35*c* of the pack holding portion 35 is in a state capable of receiving the next pack P corresponding to the chute portion 36. The inversion device 30*a* transfers the pack P while rotating thus.

Thus, according to a configuration of the present embodiment, the inversion device 30*a* includes the inversion support portion 31 configured to invert the conveyance surface 5*s*; and the pack holding portion 35 provided at the position facing the inversion support portion 31, sliding the tofu A1 covered with the pack P from the conveyance surface 5*s* to accommodate the tofu A1, and further hold the tofu A1. and rotationally moving the tofu Al until the pack P is inverted upside down, so that the pack P accommodating the tofu P can be inverted while moving to a position away from the conveyance surface 5*s*.

Figure 15:
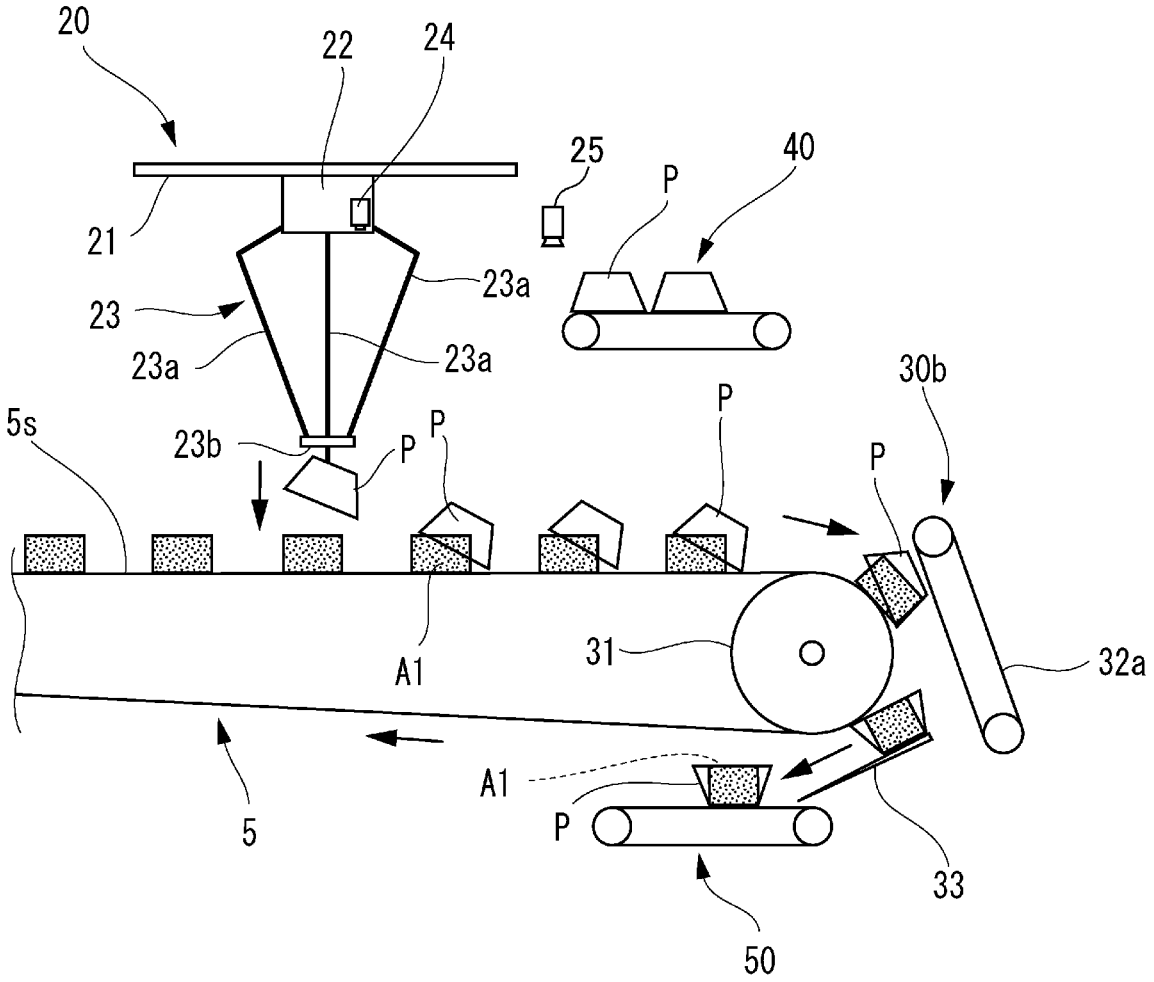
FIG. 15 is a schematic side view of a main part showing a modification of an inversion device in the packaging apparatus of the present invention.
Figure 16:
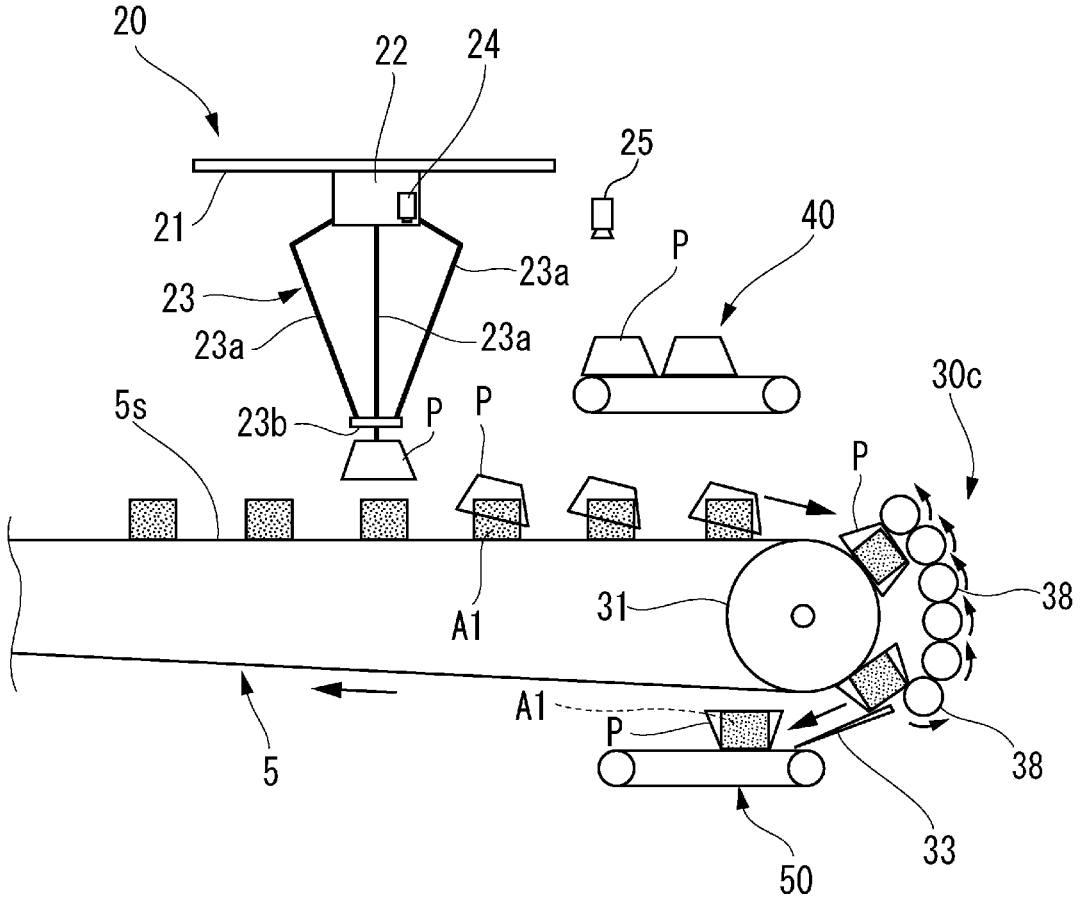
FIG. 16 is a schematic side view of a main part showing a modification of an inversion device in the packaging apparatus of the present invention.

In the inversion device 30 according to the first embodiment described above, the pack holding portion 32 is formed of an arc-shaped plate member, and in addition, as a modification, a configuration as shown in FIGS. 15 and 16 may be adopted. In FIGS. 15 and 16, the same components as those of the first embodiment are denoted by the same reference signs, and description thereof is omitted.

In an inversion device 30*b* shown in FIG. 15, an endless belt 32*a* is provided at a position facing the inversion support portion 31 so that the pack P can be inverted. The belt 32*a* is rotationally driven so as to rotate in accordance with movement of the pack P. In the case of the present modification, a portion that holds the bottom portion Pb of the pack P at the time of inversion moves in accordance with the movement of the pack P, and elasticity and loosely adjusted tension of the belt 32*a* allows the pack P to be inverted and transferred while being held softly.

In an inversion device 30*c* shown in FIG. 16, a plurality of rotating rollers 38 that are rotationally driven are disposed in an arc shape at positions facing the inversion support portion 31. It is preferable that a distance between the inversion support portion 31 and the rotating roller 38 is formed as a narrowing passage from the receiving side toward the discharging side. In this case, the pack P is inverted while the bottom portion Pb of the pack P is held by the rotating roller 38. In addition, in the case of the present modification, since a portion holding the bottom portion Pb of the pack P is the continuously arranged rotating rollers 38, the rotating rollers 38 can apply a slight vibration to the pack P, and it is possible to invert and transfer the pack P by applying the slight vibration while feeding the pack P. As a result, discharge of air between the pack P and the tofu Al can be promoted.

Although the embodiments of the present invention are described above, the present invention is not limited to the above embodiments. For example, although the image sensor 24 is provided in the pack covering device 20 in the above embodiment, the present invention is not particularly limited thereto, and a plurality of image sensors 24 may be provided.

In addition, in the embodiment described above, a case where the pack covering device 20 grips one pack P is described in the drawings, but a plurality of packs P may be simultaneously gripped for a covering processing.

In addition, in the embodiments described above, the parallel link mechanism is a robot using four-shaft link shafts, but the number of shafts (degrees of freedom) may be increased as appropriate, such as a shaft that rotates the tip end grip portion that grips the pack or a shaft that inclines the tip end grip portion, and the number of link shafts is not limited thereto. In addition, instead of the robot having the parallel link mechanism 23, a horizontal multi-joint robot (SCARA robot (3 shafts to 5 shafts)) or a vertical multi-joint robot (serial link robot (3 shafts to 7 shafts)) may be used as long as the robot has a high-speed processing capacity of 100 CPM or more.

A shape of the bottom portion Pb of the pack P is not limited to the shown shape, and for example, a groove may be formed in the bottom portion Pb, and the groove of the bottom portion Pb and the groove of the side wall portion Pw may form a continuous groove.

In the inversion device 30*a* according to the third embodiment described above, the pack holding portion 35 has a configuration in which the pair of pack accommodating portions 35*c* are formed on an opposite side by 180 degrees with respect to a center of the rotation shaft 34, but the pack accommodating portion 35*c* may have a configuration of one or more than two instead of two.

REFERENCE SIGNS LIST

1 tofu packaging apparatus
3 first transfer conveyor
5 second transfer conveyor (transfer conveyor)
5*s* conveyance surface
20 pack covering device
21 support rail
22 moving base portion
23 parallel link mechanism
23*b* tip end grip portion
24 image sensor
25 second image sensor
30, 30*a*, 30*b*, 30*c* inversion device
31 inversion support portion
32, 32*a*, 35, 38 pack holding portion
A continuous sheet-shaped tofu
A1 tofu in one unit cake
P pack

The invention claimed is:

1. A tofu packaging apparatus comprising:

a pack covering device configured to cover each of a plurality of cakes of tofu with a pack that is in a reversed state, the plurality of cakes of tofu being arranged at predetermined intervals in front, rear, left, and right directions on a conveyance surface of a transfer conveyor; and an inversion device disposed on a downstream side of the pack covering device, the inversion device being configured to invert the tofu upside down while the tofu is covered with the pack, wherein the pack covering device comprises a tip end grip portion configured to grip the pack in the reversed state and cover the tofu halfway with the pack, wherein the inversion device is configured to invert the tofu covered halfway with the pack in the reversed state to store the tofu in the pack, and wherein the pack covering device comprises a robot having a parallel link mechanism or a SCARA mechanism configured to drive the tip end grip portion three-dimensionally at high speed while the tip end grip portion grips the pack.

2. The tofu packaging apparatus according to claim 1, wherein the inversion device comprises:

an inversion support portion configured to invert the conveyance surface; and a pack holding portion disposed along the conveyance surface on the inversion support portion, the pack holding portion being configured to hold the pack until the pack is inverted.

3. The tofu packaging apparatus according to claim 1, wherein the inversion device comprises:

an inversion support portion configured to invert the conveyance surface; and a pack holding portion provided at a position facing the inversion support portion, the pack holding portion being configured to: accommodate and hold the tofu, the tofu being covered with the pack and slid from the conveyance surface; and guide the tofu while fixedly supporting the tofu until the pack is inverted upside down or rotationally move until the pack is inverted upside down.

4. The tofu packaging apparatus according to claim 1, wherein the pack covering device comprises an image sensor configured to detect a state of the tofu.

5. The tofu packaging apparatus according to claim 4, wherein in response to detection of an abnormality in the tofu as a result of image analysis of the tofu by the image sensor, the tofu is not covered with the pack.

6. The tofu packaging apparatus according to claim 1, wherein two units of pack covering devices are provided on left and right sides in a width direction of the conveyance surface, respectively, or three units of pack covering devices are provided in a center and on the left and right sides in the width direction of the conveyance surface, respectively.

7. The tofu packaging apparatus according to claim 1, wherein the pack covering device covers the tofu with the pack in an oblique posture with a downstream side of the pack positioned vertically below an upstream side of the pack.

8. The tofu packaging apparatus according to claim 1, wherein the tofu has a hardness of 20 gf/cm2 to 100 gf/cm2.

9. The tofu packaging apparatus according to claim 1, wherein the pack has a groove on an inner surface of the pack, the groove extending at least from a bottom portion of the pack toward an opening of the pack.

10. The tofu packaging apparatus according to claim 1, further comprising:

a pack supply device configured to supply the pack, wherein the pack supply device comprises at least one pack supply magazine configured to stock packs.

11. The tofu packaging apparatus according to claim 10, wherein the pack supply device comprises a conveyor configured to continuously convey the packs.

12. The tofu packaging apparatus according to claim 10, wherein the pack supply device comprises an image sensor configured to detect a state of the packs.

13. The tofu packaging apparatus according to claim 1, wherein the pack covering device supports IP54 of a dustproof and waterproof grade or greater.

14. The tofu packaging apparatus according to claim 1, wherein the pack covering device comprises a moving base portion.

* * * * *